US006555307B2

(12) United States Patent
Maruyama

(10) Patent No.: US 6,555,307 B2
(45) **Date of Patent: *Apr. 29, 2003**

(54) SILVER HALIDE PHOTOGRAPHIC EMULSION AND SILVER HALIDE PHOTOGRAPHIC LIGHT-SENSITIVE MATERIAL CONTAINING THE EMULSION

(75) Inventor: Yoichi Maruyama, Minami-Ashigara (JP)

(73) Assignee: Fuji Photo Film, Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/217,925

(22) Filed: Dec. 22, 1998

(65) Prior Publication Data

US 2001/0006768 A1 Jul. 5, 2001

(30) Foreign Application Priority Data

Dec. 24, 1997 (JP) ..... 9-355891

(51) Int. Cl.[7] ..... G03C 1/035

(52) U.S. Cl. ..... 430/567; 430/569; 430/600; 430/605

(58) Field of Search ..... 430/605, 567, 430/569, 600

(56) References Cited

U.S. PATENT DOCUMENTS 4,614,711 A * 9/1986 Sugimoto et al. ..... 430/567
5,275,930 A * 1/1994 Maskasky ..... 430/567
5,482,826 A * 1/1996 Okamura et al. ..... 430/567
5,698,387 A * 12/1997 Reed et al. ..... 430/567
5,736,311 A * 4/1998 Urabe ..... 430/567
5,783,378 A * 7/1998 Mydlarz et al. ..... 430/567

FOREIGN PATENT DOCUMENTS

JP 4-278940 * 10/1992 ..... G03C/1/09
JP 4-368938 * 12/1992 ..... G03C/7/36
JP 5-34855 * 2/1993 ..... G03C/1/09

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide photographic emulsion in which tabular grains each having an equivalent-circle diameter of 0.6 $\mu$m or more, a thickness of 0.3 $\mu$m or less, and an aspect ratio of 2 or more account for 70% or more in number of all the grains contained therein, wherein each of the tabular grains has a multilayered structure including two or more layers, at least one of the layers contains 1 to 20 mol % of a chloride with respect to the silver amount contained in the at least one of the layers, and each of the tabular grains contains a metal complex represented by formula (C-1) or (C-2) below:

$$[M_1(CN)_{6-a}L_a]^n \quad \text{(C-1)}$$

$$[M_2(CN)_{4-b}L_b]^m \quad \text{(C-2)}$$

wherein $M_1$ represents Fe, Ru, Re, Os, Ir, or Pt; $M_2$ represents Pt or Au; L represents a ligand except for CN; a represents 0, 1, or 2; b represents 0, 1, or 2; n represents 2-, 3-, or 4-; and m represents 1- or 2-.

13 Claims, No Drawings

SILVER HALIDE PHOTOGRAPHIC EMULSION AND SILVER HALIDE PHOTOGRAPHIC LIGHT-SENSITIVE MATERIAL CONTAINING THE EMULSION

BACKGROUND OF THE INVENTION

The present invention relates to a silver halide photographic emulsion and a silver halide photographic light-sensitive material and, more particularly, to a silver halide photographic emulsion with high sensitivity and high graininess and a silver halide photographic light-sensitive material containing the emulsion.

Methods of manufacturing and techniques of using tabular silver halide grains are already disclosed in, e.g., U.S. Pat. No. 4,434,226, U.S. Pat. No. 4,439,520, U.S. Pat. No. 4,414,310, U.S. Pat. No. 4,433,048, U.S. Pat. No. 4,414,306, and U.S. Pat. No. 4,459,353. Advantages such as improvement of the sensitivity/graininess relationship including improvement of the sensitization efficiency obtained by spectral sensitizing dyes are known.

Extensive research has been done to use tabular grains having these advantages in a large size region greatly contributing to the performance of color negative sensitive materials.

Jpn. Pat. Appln. KOKAI Publication No. (hereinafter referred to as JP-A-) 63-220238 has disclosed a technique of increasing the sensitivity and improving the resistance to pressure by introducing dislocations.

Also, as a technique of using metal compounds, U.S. Pat. No. 5,576,172 has disclosed a method of increasing the sensitivity and improving the low illumination intensity failure by using both of group VIII elements and Ir element.

Unfortunately, small formatting of color negative films has advanced as shown in the APS format, so demands on improved image quality cannot be satisfied even by the use of these conventional techniques. Accordingly, a technique of further improving the sensitivity has been desired.

BRIEF SUMMARY OF THE INVENTION

It is an object of the present invention to provide a silver halide photographic emulsion with high sensitivity and high graininess and a silver halide photographic light-sensitive material containing the emulsion.

DETAILED DESCRIPTION OF THE INVENTION (1) A silver halide photographic emulsion in which tabular grains having an equivalent-circle diameter of 0.6 μm or more, a thickness of 0.3 μm or less, and an aspect ratio of 2 or more account for 70% or more (in number), wherein each of the tabular grains has a multilayered structure including two or more layers, at least one of the layers contains 1 to 20 mol % of a chloride with respect to the amount of silver forming the layer and each of the tabular grains contain a metal complex represented by formula (C-1) or (C-2) below:

$$[M_1(CN)_{6-a}L_a]^n \quad \text{(C-1)}$$

$$[M_2(CN)_{4-b}L_b]^m \quad \text{(C-2)}$$

wherein $M_1$: Fe, Ru, Re, Os, Ir, or Pt $M_2$: Pt or Au

L: a ligand except for CN a: 0, 1, or 2 b: 0, 1, or 2 n: 2-, 3-, or 4-m: 1- or 2-;

(2) The silver halide photographic emulsion described in item (1) above, wherein dislocation lines are observed in 80% or more (in number) of the tabular grains;

(3) The silver halide photographic emulsion described in item (2) above, wherein the variation coefficient of the equivalent-circle diameters of the tabular grains is 25% or less;

(4) The silver halide photographic emulsion described in any one of items (1) to (3) above, wherein the average aspect ratio of the tabular grains is 8 or more; and (5) A silver halide photographic light-sensitive material having one or more silver halide emulsion layers on a support, wherein at least one of the emulsion layers contains the silver halide photographic emulsion described in any one of items (1) to (4) above.

The present invention will be described in detail below.

The emulsion of the present invention contains 70% or more (in number) of tabular silver halide grains having an equivalent-circle diameter of 0.6 μm or more. A "tabular silver halide grain" is a general term of grains having one twin plane or two or more parallel twin planes or grains which have no twin planes and principally have (110) main surfaces. A "twin plane" is a (111) plane on both sides of which all ions at lattice points have a mirror image relationship to each other. When this tabular grain is viewed from the direction perpendicular to the main surface, it looks like a triangle, a square, a hexagon, or a form obtained from a triangle, a square or a hexagon by making each corner thereof roundish. These triangular, square, hexagonal, and circular grains have parallel triangular, square, hexagonal, and circular main surfaces, respectively.

In the present invention, an equivalent-circle diameter is the diameter of a circle having the same area as the projected area of the parallel main surfaces of a grain.

The projected area of a grain can be obtained by measuring the area on an electron micrograph and correcting the magnification.

The thickness of a grain can be easily measured by obliquely depositing a metal on a grain, together with a latex as a reference, measuring the length of the shadow of the latex and the grain in an electron micrograph, and calculating by referring to the length of the shadow of the latex.

In the present invention, the aspect ratio of a tabular grain is the value obtained by dividing the equivalent-circle diameter by the grain thickness. The average aspect ratio is the average value of the aspect ratios of 1,000 or more grains in an emulsion.

The equivalent-circle diameter of each of the tabular grains occupying 70% or more of all the grains in the emulsion of the present invention is preferably 0.6 μm or more, more preferably 0.6 to 5.0 μm, and most preferably 0.8 to 3.0 μm.

The thickness of each of the tabular grains occupying 70% or more of all the grains in the emulsion of the present invention is preferably 0.03 to 0.3 μm, more preferably 0.03 to 0.25 μm, and most preferably 0.05 to 0.20 μm.

The average aspect ratio of each of the tabular grains occupying 70% or more of all the grains in the emulsion of the present invention is 2 or more, preferably 8 to 50, more preferably 8 to 40, and most preferably 8 to 30.

Each of the tabular grains used in the present invention has a multilayered structure including two or more layers, i.e., so to call a core/shell structure. Portions of a grain having different halogen compositions are called "layers". For example, a grain composed of a portion having an iodide content of 20 mol %, i.e., core portion, and a portion having an iodide content of 5 mol %, i.e., a first shell, has a two-layered structure.

Each of the tabular grains used in the present invention has at least one layer containing 1 to 20 mol % of a chloride with respect to the silver amount of the layer. The chloride content is more preferably 1 to 15 mol %, and most preferably 3 to 10 mol %.

When a chloride is contained in at least one layer, the rest of the halogen composition in the layer can have arbitrary bromide and/or iodide content. However, the iodide content is preferably 0 to 35 mol %, more preferably 1 to 20 mol %, and most preferably 2 to 10 mol %.

The composition of each of the tabular grains used in the invention can be silver chlorobromide, silver chloroiodide or silver chloroiodobromide. The chloride content of the silver halides is 0.1 to 10 mol %, preferably 0.1 to 5 mol %, and most preferably 0.1 to 3 mol %. The silver iodide content of the silver halides, if any, is 0.1 to 20 mol %, preferably 0.1 to 15 mol %, and most preferably 0.1 to 10 mol %.

The halogen composition structure of a tabular grain used in the present invention can be checked by combining, e.g., X-ray diffraction, a transmission analytical electron microscope (analytical TEM), EPMA (also called XMA; a method of scanning a silver halide grain by electron rays to detect its silver halide composition), and ESCA (also called XPS; a method of radiating X-rays to spectroscopically detect photoelectrons emitted from the surface of a grain).

The relative standard deviation of the inter-grain silver iodide distribution and silver chloride distribution of a silver halide emulsion of the present invention is not particularly restricted. However, this relative standard deviation is preferably 50% or less, more preferably 35% or less, and most preferably 20% or less.

The halogen contents of individual emulsion grains can be measured by analyzing the composition of each grain by using, e.g., an X-ray microanalyzer. The "relative standard deviation of the halogen contents of individual grains", explaining taking an example of silver iodide deviation, is the value obtained by dividing the standard deviation of halogen contents, when the silver iodide contents of at least 100 emulsion grains are measured by, e.g., an X-ray microanalyzer, by the average halogen content and multiplying the quotient by 100. A practical method of measuring the halogen contents of individual grains is described in, e.g., E.P. 147,868A, the disclosure of which is herein incorporated by reference.

If the relative standard deviation of the silver iodide contents and silver chloride contents of individual grains is large, these grains have different appropriate points in chemical sensitization. Consequently, it becomes impossible to fully utilize the properties of all emulsion grains. Additionally, the inter-grain relative standard deviation of the number of dislocations tends to increase.

A silver iodide content Yi (mol %) and an equivalent-sphere diameter Xi (micron) of each grain and silver chloride content Yc (mol %) and an equivalent-sphere diameter Xc (micron) of each grain sometimes have a correlation. However, it is desirable not to have any correlation.

It is sometimes possible to obtain more preferable effects by using monodisperse tabular grains. Although the structure and the method of manufacturing monodisperse tabular grains are described in, e.g., JP-A-63-151618, the disclosure of which is herein incorporated by reference, the shape of the grains will be briefly described below. That is, tabular grains having two parallel main surfaces occupy 70% or more of the total projected area of all the grains in an emulsion. Each of the main surface of the tabular grains has a shape, that is viewed from the direction perpendicular to the main surface, in which the ratio of an edge having the maximum length with respect to the length of an edge having the minimum length is 2 or less. And in addition, the tabular grains have monodispersibility. The monodispersibility is herein defined as the variation coefficient of the grain size distribution is 25% or less, preferably 20% or less, most preferably 15% or less. The variation coefficient is the value obtained by dividing a variation (standard deviation) in grain sizes represented by equivalent-circle diameters of projected areas of each of the grains, by their average of the grain sizes.

In the present invention, tabular grains preferably have dislocation lines.

Dislocation lines in tabular grains can be observed by a direct method performed at a low temperature using a transmission electron microscope, as described in, for example, J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damages (e.g., print out) due to electron rays. In this case, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). From photographs of grains obtained by the above method, it is possible to obtain the positions and the number of dislocations in each grain viewed in a direction perpendicular to the main surfaces of the grain.

Dislocations are produced from a position x% of the length between the center and the edge of a tabular grain to the edge in the major axis direction of the grain. The value of x is preferably $10 \leqq x < 100$, more preferably $30 \leqq x < 98$, and most preferably $50 \leqq x < 95$. If this is the case, the shape obtained by connecting the start positions of the dislocations is almost similar to the shape of the grain. However, this shape is sometimes distorted, not perfectly similar. Dislocation lines are generally extended in a direction from the center to the edge but are sometimes zigzagged.

Grains containing five or more dislocations account for preferably 50% (in number) or more, and more preferably 80% (in number) of more. Most preferably, grains containing 10 or more dislocations account for 80% (in number) or more.

A method of manufacturing tabular grains used in the present invention will be described below.

Tabular grains used in the present invention can be prepared by the methods described in, e.g., Cleve, Photography Theory and Practice (1930), page 13; Gutoff, Photographic Science and Engineering, Vol. 14, pages 248 to 257, (1970); and U.S. Pat. No. 4,434,226, U.S. Pat. No. 4,414,310, U.S. Pat. No. 4,433,048, and U.S. Pat. No. 4,439,520, and British Patent 2,112,157, the disclosures of which are herein incorporated by reference.

A metal complex of Fe, Ru, Re, Os, Ir, Pt, or Au used in the present invention and containing at least two cyan ligands is preferably represented by formula (C-1) or (C-2) below:

$$[M_1(CN)_{6-a}L_a]^n \quad \text{(C-1)}$$

$$[M_2(CN)_{4-b}L_b]^m \quad \text{(C-2)}$$

(wherein $M_1$: Fe, Ru, Re, Os, Ir, or Pt $M_2$: Pt or Au

L: a ligand except for CN a: 0, 1, or 2 b: 0, 1, or 2 n: 2-, 3-, or 4-m: 1- or 2-)

Examples of a ligand except for CN, represented by L are F, Cl, Br, I, $H_2O$, SCN, NO, pyrazole, imidazole and triazole.

A metal complex represented by formula (C-1) of the above two formulas is more preferably used. As $M_1$ in formula (C-1), Fe, Ru, Re, Os, or Ir is preferable, and Fe is most preferable.

Practical examples of the metal complex used in the present invention and having at least two cyan ligands are presented below.

| | |
|---|---|
| $[Fe(CN)_6]^{3-}$, | $[Fe(CN)_5F]^{3-}$ |
| $[Fe(CN)_4F_2]^{3-}$, | $[Fe(CN)_5Cl]^{3-}$ |
| $[Fe(CN)_4Cl_2]^{3-}$, | $[Fe(CN)_5Br]^{3-}$ |
| $[Fe(CN)_4Br_2]^{3-}$, | $[Fe(CN)_5(SCN)]^{3-}$ |
| $[Fe(CN)_5(SCN)]^{3-}$, | $[Fe(CN)_5(NO)]^{3-}$ |
| $[Fe(CN)_5(H_2O)]^{2-}$, | $[Fe(CN)_6]^{4-}$ |
| $[Fe(CN)_5F]^{4-}$, | $[Fe(CN)_4F_2]^{4-}$ |
| $[Fe(CN)_5Cl]^{4-}$, | $[Fe(CN)_5Cl_2]^{4-}$ |
| $[Fe(CN)_5Br]^{4-}$, | $[Fe(CN)_4Br_2]^{4-}$ |
| $[Fe(CN)_5(SCN)]^{4-}$, | $[Fe(CN)_5(SCN)]^{4-}$ |
| $[Fe(CN)_5(NO)]^{4-}$, | $[Fe(CN)_5(H_2O)]^{3-}$ |
| $[Fe(CN)_5(PZ)]^{3-}$ | $[Fe(CN)_4(PZ)_2]^{2-}$ |
| $[Fe(CN)_5(Im)]^{3-}$ | $[Fe(CN)_4(Im)_2]^{2-}$ |
| $[Fe(CN)_5(trz)]^{3-}$ | $[Fe(CN)_4(trz)_2]^{2-}$ |
| $[Ru(CN)_6]^{4-}$, | $[Ru(CN)_5F]^{4-}$ |
| $[Ru(CN)_4F_2]^{4-}$, | $[Ru(CN)_5Cl]^{4-}$ |
| $[Ru(CN)_4Cl_2]^{4-}$, | $[Ru(CN)_5Br]^{4-}$ |
| $[Ru(CN)_4Br_2]^{4-}$, | $[Ru(CN)_5I]^{4-}$ |
| $[Ru(CN)_4I_2]^{4-}$, | $[Ru(CN)_5(SCN)]^{4-}$ |
| $[Ru(CN)_5(SCN)]^{4-}$ | $[Ru(CN)_5(NO)]^{4-}$ |
| $[Ru(CN)_5(H_2O)]^{3-}$, | $[Re(CN)_6]^{4-}$ |
| $[Ru(CN)_5(PZ)]^{3-}$ | $[Ru(CN)_4(PZ)_2]^{2-}$ |
| $[Ru(CN)_5(Im)]^{3-}$ | $[Ru(CN)_4(Im)_2]^{2-}$ |
| $[Ru(CN)_5(trz)]^{3-}$ | $[Ru(CN)_4(trz)_2]^{2-}$ |
| $[Re(CN)_5F]^{4-}$, | $[Re(CN)_4F_2]^{4-}$ |
| $[Re(CN)_5Cl]^{4-}$, | $[Re(CN)_4Cl_2]^{4-}$ |
| $[Re(CN)_5Br]^{4-}$, | $[Re(CN)_4Br_2]^{4-}$ |
| $[Re(CN)_5I]^{4-}$, | $[Re(CN)_4I_2]^{4-}$ |
| $[Os(CN)_6]^{4-}$, | $[Os(CN)_5F]^{4-}$ |
| $[Os(CN)_4F_2]^{4-}$, | $[Os(CN)_5Cl]^{4-}$ |
| $[Os(CN)_4Cl_2]^{4-}$, | $[Os(CN)_5Br]^{4-}$ |
| $[Os(CN)_4Br_2]^{4-}$, | $[Os(CN)_5I]^{4-}$ |
| $[Os(CN)_4I_2]^{4-}$, | $[Os(CN)_5(SCN)]^{4-}$ |
| $[Os(CN)_5(PZ)]^{3-}$ | $[Os(CN)_4(PZ)_2]^{2-}$ |
| $[Os(CN)_5(Im)]^{3-}$ | $[Os(CN)_4(PZ)_2]^{2-}$ |
| $[Os(CN)_5(trz)]^{3-}$ | $[Os(CN)_4(trz)]^{2-}$ |
| $[Os(CN)_5(SCN)]^{4-}$, | $[Os(CN)_5(NO)]^{4-}$ |
| $[Os(CN)_5(H_2O)]^{3-}$, | $[Ir(CN)_6]^{3-}$ |
| $[Ir(CN)_5Cl]^{3-}$, | $[Ir(CN)_4Cl_2]^{3-}$ |
| $[Ir(CN)_5Br]^{3-}$, | $[Ir(CN)_4Br_2]^{3-}$ |
| $[Ir(CN)_5I]^{3-}$, | $[Ir(CN)_4I_2]^{3-}$ |
| $[Ir(CN)_5(NO)]^{3-}$, | $[Ir(CN)_5(H_2O)]^{2-}$ |
| $[Pt(CN)_4]^{2-}$, | $[Pt(CN)_4Cl_2]^{2-}$ |
| $[Pt(CN)_4Br_2]^{2-}$, | $[Pt(CN)_4I_2]^{2-}$ |
| $[Au(CN)_4]^{-}$, | $[Au(CN)_2Cl_2]^{2-}$ |

PZ = pyrazole, Im = imidazole, trz = triazole

As counter ions of these metal complexes, ammonium ion, and alkali metal ions such as sodium and potassium ions are preferably used.

Though the metal complex in a form of ion as represented by formula (C-1) or (C-2) may exist in the tabular grains used in the invention, salts thereof with one of the counter ions can be added to prepare the tabular grains.

The content of the metal complex having at least two cyan ligands used in the present invention is preferably $1.0\times10^{-7}$ to $1.0\times10^{-3}$ mol, and more preferably $1.0\times10^{-5}$ to $5\times10^{-4}$ mol per mol of a silver halide.

It is preferable to dissolve these metal complexes in water or an appropriate solvent and directly add the resultant solution to a reaction solution during the formation of silver halide grains, or add the metal complexes to an aqueous halide solution, an aqueous silver salt solution, or some other solution for forming silver halide grains and perform grain formation. It is also preferable to dissolve silver halide fine grains containing these metal complexes and deposit the fine grains on other silver halide grains. There is no particular limited timing at which the metal complexed are added during the formation of the tabular grains.

When these metal complexes are added, the hydrogen ion concentration or pH of the reaction solution is preferably 1 to 10, and more preferably 3 to 7.

In addition to the metal complexes having at least two cyan ligands, silver halide grains used in the present invention preferably contain the following metal complexes or metal salts: hexachloroiridate(III) or (IV), hexaamineiridate (III) or (IV), trioxalatoiridate(III) or (IV), hexacyanoferrate (II) or (III), ferrous thiocyanate, and ferric thiocyanate.

The addition amount of the above iridium ion is preferably $10^{-9}$ to $10^{-6}$ mol, and most preferably $10^{-8}$ to $10^{-6}$ mol per mol of a silver halide. The addition amount of the above iron ion is preferably $10^{-8}$ to $10^{-4}$ mol, and most preferably $10^{-7}$ to $10^{-4}$ mol per mol of a silver halide.

When the present invention is applied to a color sensitive material, at least one sensitive layer needs only to be formed on a support. A typical example is a silver halide photographic light-sensitive material having, on its support, at least one sensitive layer constituted by a plurality of silver halide emulsion layers which are sensitive to essentially the same color but have different sensitivities. This sensitive layer is a unit sensitive layer sensitive to one of blue light, green light, and red light. In a multilayered silver halide color photographic light-sensitive material, such unit sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-sensitive layers can be formed between the silver halide sensitive layers and as the uppermost layer and the lowermost layer. These non-sensitive layers can contain, e.g., couplers, DIR compounds, and color-mixing inhibitors to be described later. As a plurality of silver halide emulsion layers constituting each unit sensitive layer, as described in DE1,121,470 or GB923,045, high- and low-speed emulsion layers are preferably arranged such that the sensitivity is sequentially decreased toward a support. In addition, as described in JP-A-57-112751, JP-A-62-200350, JP-A-62-206541, and JP-A-62-206543, the disclosures of which are herein incorporated by reference, layers can be arranged such that a low-speed emulsion layer is formed apart from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in Jpn. Pat. Appln. KOKOKU Publication No. (hereafter referred to as JP-B-) 55-34932, layers can be arranged from the farthest side from a support in the order of blue-sensitive layer/GH/RH/GL/RL. Furthermore, as described in JP-A-56-25738 and JP-A-62-63936, the disclosures of which are herein incorporated by reference, layers can be arranged from the farthest side from a support in the order of blue-sensitive layer/GL/RL/GH/RH.

As described in JP-B-49-15495, the disclosure of which is herein incorporated by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward the support. When a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is herein incorporated by reference.

In addition, the order of high-speed emulsion layer/low-speed emulsion layer/medium-speed emulsion layer or low-speed emulsion layer/medium-speed emulsion layer/high-speed emulsion layer can be used. Furthermore, the arrangement can be changed as described above even when four or more layers are formed.

There is no particular limited layer to which the emulsion of the invention can be added.

In order to improve the color reproduction, a donor layer (CL) with an interlayer effect, which is described in U.S. Pat. No. 4,663,271, U.S. Pat. No. 4,705,744, U.S. Pat. No. 4,707,436, JP-A-62-160448, or JP-A-63-89850, the disclosures of which are herein incorporated by reference and different from the main sensitive layers BL, GL, and RL in spectral sensitivity distribution, is preferably formed adjacent to or close to the main sensitive layers.

The photographic light-sensitive material containing the emulsion of the invention can further contain following silver halide emulsion.

The silver halide used in the additional emulsion is silver iodobromide, silver iodochloride, or silver bromochloroiodide containing about 30 mol % or less of silver iodide. The silver halide is most preferably silver iodobromide or silver bromochloroiodide containing about 2 to about 10 mol % of silver iodide.

Silver halide grains contained in the additional photographic emulsion can have regular crystals such as cubic, octahedral, or tetradecahedral crystals, irregular crystals such as spherical or tabular crystals, crystals having crystal defects such as twin planes, or composite shapes thereof.

The silver halide can consist of fine grains having a grain size of about 0.2 $\mu$m or less or large grains having a projected area diameter of up to about 10 $\mu$m, and the emulsion can be either a polydisperse or monodisperse emulsion.

The silver halide photographic emulsion which can be used in the light-sensitive material of the present invention can be prepared by methods described in, for example, "I. Emulsion preparation and types," Research Disclosure (RD) No. 17,643 (December, 1978), pp. 22 and 23, RD No. 18,716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are herein incorporated by reference.

Monodisperse emulsions described in, e.g., U.S. Pat. No. 3,574,628, U.S. Pat. No. 3,655,394, and GB1,413,748 are also preferred, the disclosures of which are herein incorporated by reference.

Tabular grains having an aspect ratio of 3 or more can also be used in the light-sensitive material of the present invention. Tabular grains can be easily prepared by methods described in Gutoff, "Photographic Science and Engineering", Vol. 14, pp. 248 to 257 (1970); and U.S. Pat. No. 4,434,226, U.S. Pat. No. 4,414,310, U.S. Pat. No. 4,433,048, U.S. Pat. No. 4,439,520, and GB2,112,157, the disclosures of which are herein incorporated by reference.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or zinc oxide can be bonded. A mixture of grains having various types of crystal shapes can be used.

The above emulsion that can additionally be used in the light-sensitive material of the invention can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated by reference. A method of preparing this core/shell internal latent image type emulsion is described in JP-A-59-133542, the disclosure of which is incorporated by reference. Although the thickness of a shell of this emulsion depends on, e.g., development conditions, it is preferably 3 to 40 nm, and most preferably 5 to 20 nm.

The silver halide emulsion used in the photographic material is normally subjected to physical ripening, chemical ripening, and spectral sensitization steps before it is used. Additives for use in these steps are described in RD Nos. 17,643, 18,716, and 307,105, the disclosures of which are herein incorporated by reference, and they are summarized in a table to be presented later.

In the sensitive material of the present invention, it is possible to mix, in a single layer, two or more types of emulsions different in at least one of characteristics of a sensitive silver halide emulsion, i.e., a grain size, a grain size distribution, a halogen composition, a grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, the disclosures of which are herein incorporated by reference, and colloidal silver, in at least one sensitive silver halide emulsion layer and/or at least one substantially non-sensitive hydrophilic colloid layer. The internally fogged or surface-fogged silver halide grain means a silver halide grain which can be developed uniformly (non-imagewise) regardless of whether the location is a non-exposed portion or an exposed portion of the sensitive material. A method of preparing the internally fogged or surface-fogged silver halide grain is described in U.S. Pat. No. 4,626,498 and JP-A-59-214852, the disclosures of which are herein incorporated by reference. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably 0.05 to 0.6 $\mu$m. The grain shape can be a regular grain shape.

Although the emulsion can be a polydisperse emulsion, it is preferably a monodisperse emulsion (in which at least 95% in weight or number of grains of silver halide grains have grain sizes falling within a range of ±40% of the average grain size).

In the photographic material of the present invention, it is preferable to use a non-light-sensitive fine grain silver halide. The non-light-sensitive fine grain silver halide preferably consists of silver halide grains which are not exposed during imagewise exposure for obtaining a dye image and are not substantially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 $\mu$m, and more preferably 0.02 to 0.2 $\mu$m.

The fine grain silver halide can be prepared following the same procedures as for a common sensitive silver halide. In this case, the surface of each silver halide grain need not be optically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be added to this fine grain silver halide grain-containing layer.

The silver coating amount of a sensitive material of the present invention is preferably 6.0 g/m$^2$ or less, and most preferably 4.5 g/m$^2$ or less.

Photographic additives usable in the present invention are also described in RDs, and the relevant portions, the disclosures of which are herein incorporated by reference, are summarized in the following table.

| | Additives | RD17643 | RD18716 |
|---|---|---|---|
| 1. | Chemical sensitizers | page 23 | page 648, right column |
| 2. | Sensitivity increasing agents | | the same as above |
| 3. | Spectral sensitizers, super sensitizers | pages 23–24 | page 648, right column to page 649, right column |
| 4. | Brighteners | page 24 | page 647, right column |
| 5. | Light absorbents, filter dyes, ultraviolet absorbents | pages 25–26 | page 649, right column to page 650, left column |
| 6. | Binders | page 26 | page 651, left column |
| 7. | Plasticizers, lubricants | page 27 | page 650, right column |
| 8. | Coating aids, surface active agents | pages 26–27 | the same as above |
| 9. | Antistatic agents | page 27 | the same as above |
| 10. | Matting agents | | |

-continued

| | Additives | RD307105 |
|---|---|---|
| 1. | Chemical sensitizers | page 866 |
| 2. | Sensitivity increasing agents | |
| 3. | Spectral sensitizers, super sensitizers | pages 866–868 |
| 4. | Brighteners | page 868 |
| 5. | Light absorbent, filter dye, ultraviolet absorbents | page 873 |
| 6. | Binder | pages 873–874 |
| 7. | Plasticizers, lubricants | page 876 |
| 8. | Coating aids, surface active agents | pages 875–876 |
| 9. | Antistatic agents | pages 876–877 |
| 10. | Matting agent | pages 878–879 |

Various dye forming couplers can be used in a sensitive material of the present invention, and the following couplers are particularly preferable. The disclosures of the documents disclosing the couplers one herein incorporated by reference.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of Japanese Patent Application No. 4-134523; a coupler represented by formula (I) in column 1, lines 45 to 55, in U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 in EP447,969A1; and couplers (particularly II-17, II-19 (column 17), and II-24 (column 19)) represented by formulas (II) to (IV) in column 7, lines 36 to 58, in U.S. Pat. No. 4,476,219.

Magenta couplers: JP-A-3-39737 (L-57 (page 11, lower right column), L-68 (page 12, lower right column), and L-77 (page 13, lower right column); A-4 and A-63 (page 134), and A-4, A-73, and A-75 (page 139) in EP456,257; M-4 and M-6 (page 26), and M-7 (page 27) in EP486,965; M-45 in paragraph 0024 of Japanese Patent Application No. 4-234120; M-1 in paragraph 0036 of Japanese Patent Application No. 4-36917; and M-22 in paragraph 0237 of JP-A-4-362631.

Cyan couplers: CX-1, CX-3, CX-4, CX-5, CX-11, CX-12, CX-14, and CX-15 (pages 14 to 16) in JP-A-4204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of Japanese Patent Application No. 4-236333.

Polymer couplers: P-1 and P-5 (page 11) in JP-A-2-44345.

Couplers for forming a colored dye with a proper diffusibility are preferably those described in U.S. Pat. No. 4,366,237, GB2,125,570, EP96,873B, and DE3,234,533.

Couplers for correcting unnecessary absorption of a colored dye are preferably yellow colored cyan couplers (particularly YC-86 on page 84) represented by formulas (CI), (CII), (CIII), and (CIV) described on page 5 in EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in WO92/11575.

Examples of a compound (including a coupler) which reacts with a developing agent oxidation product and releases a photographically useful compound residue are as follows. The disclosures of the references disclosing the compounds are herein incorporated by reference. Development inhibitor-releasing compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) in paragraph 0027) represented by formula (1) in Japanese Patent Application No. 4-134523, and compounds (particularly I-(1) on page 29) represented by formulas (I), (II), and (III) described on pages 5 and 6 of EP440,195A2; (Bleaching accelerator-releasing compounds: compounds (particularly (60) and (61) on page 61) represented by formulas (I) and (I') on page 5 of EP310,125A2, and compounds (particularly (7) (page 7)) represented by formula (I) in claim 1 of Japanese Patent Application No. 4-325564; ligand-releasing compound: compounds (particularly compounds in column 12, lines 21 to 41) represented by LIG-X described in claim 1 of U.S. Pat. No. 4,555,478; leuco dye-releasing compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerators- or fogging agent-releasing compounds: compounds (particularly (I-22) in column 25) represented by formulas (1), (2), and (3) in column 3 of U.S. Pat. No. 4,656,123, and ExZK-2 on page 75, lines 36 to 38, in EP450,637A2; compounds which release a group which does not function as a dye unless it splits off: compounds (particularly Y-1 to Y-19 in columns 25 to 36) represented by formula (I) in claim 1 of U.S. Pat. No. 4,857,447.

Preferable examples of additives other than couplers are as follows. The disclosures of the references disclosing the additives are herein incorporated by reference.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidation product scavengers: compounds (particularly I-(1), I-(2), I-(6), and I-(12) (columns 4 and 5)) represented by formula (I) in column 2, lines 54 to 62, in U.S. Pat. No. 4,978,606, and formulas (particularly a compound 1 (column 3)) in column 2, lines 5 to 10, in U.S. Pat. No. 4,923,787; stain inhibitors: formulas (I) to (III) on page 4, lines 30 to 33, particularly I-47, I-72, III-1, and III-27 (pages 24 to 48) in EP298321A; brown inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10, in columns 25 to 38 of U.S. Pat. No. 5,122,444, I-1 to III-4, particularly II-2, on pages 8 to 12 in EP471347A, and A-1 to A-48, particularly A-39 and A-42, in columns 32 to 40 of U.S. Pat. No. 5,139,931; materials which reduce the use amount of a color enhancer or a color-mixing inhibitor: I-1 to II-15, particularly I-46, on pages 5 to 24 in EP411324A; formalin scavengers: SCV-1 to SCV-28, particularly SCV-8, on pages 24 to 29 in EP477932A; film hardeners: H-1, H-4, H-6, H-8, and H-14 on page 17 in JP-A-1-214845, compounds (H-1 to H-54) represented by formulas (VII) to (XII) in columns 13 to 23 of U.S. Pat. No. 4,618,573, compounds (H-1 to H-76), particularly H-14, represented by formula (6) on page 8, lower right column, in JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7, of U.S. Pat. No. 5,019,492; antiseptic agents and mildewproofing agents: I-1 to III-43, particularly II-1, II-9, II-10, II-18, and III-25, in columns 3 to 15 of U.S. Pat. No. 4,923,790; stabilizers and antifoggants: I-1 to (14), particularly I-1, I-60, (2), and (13), in columns 6 to 16 of U.S. Pat. No. 4,923,793, and compounds 1 to 65, particularly a compound 36, in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450, F-I-1 to F-II-43, particularly F-I-11 and F-II-8, on pages 33 to 55 in EP445627A, III-1 to III-36, particularly III-1 and III-3, on pages 17 to 28 in EP457153A, fine crystal dispersions of Dye-1 to Dye-124 on pages 8 to 26 in WO88/04794, compounds 1 to 22, particularly a compound 1, on pages 6 to 11 in EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A.

The present invention can be applied to various color sensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784. Furthermore, the present invention is applicable to black-and-white sensitive materials such as black-and-white negative films and X-ray films.

A support which can be suitably used in the present invention is described in, e.g., RD. No. 17643, page 28, RD. No. 18716, from the right column, page 647 to the left column, page 648, and RD. No. 307105, page 879.

In a sensitive material of the present invention, the total film thickness of all hydrophilic colloid layers on the side having emulsion layers is preferably 28 $\mu$m or less, more preferably 23 $\mu$m or less, particularly preferably 18 $\mu$m or less, and most preferably 16 $\mu$m or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. The film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness−film thickness)/film thickness.-

In a sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The lubrication ratio of the back layers is preferably 150% to 500%.

A color sensitive material according to the present invention can be developed by conventional methods described in RD. No. 17643, pp. 28 and 29, RD. No. 18716, page 615, the left to right columns, and RD No. 307105, pp. 880 and 881.

A color developer used in the development of a sensitive material of the present invention is preferably an aqueous alkaline solution mainly consisting of an aromatic primary amine-based color developing agent. As this color developing agent, although an aminophenol-based compound is effective, a p-phenylenediamine-based compound is preferably used. Typical examples and preferable examples of the p-phenylenediamine-based compound are compounds described in EP556700A, page 28, lines 43 to 52. These compounds can be used in a combination of two or more thereof in accordance with the application.

In general, the color developer contains a pH buffering agent such as a carbonate, a borate, or a phosphate of an alkali metal, and a development restrainer or an antifoggant such as a bromide, an iodide, a benzimidazole, a benzothiazole, or a mercapto compound. If necessary, the color developer can also contain a preservative such as hydroxylamine, diethylhydroxylamine, hydrazine compounds such as N,N-biscarboxymethyl hydrazine, a sulfite, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye forming coupler; a competing coupler; an auxiliary developing agent such as 1-phenyl-3-pyrazolidone; a viscosity imparting agent; and a chelating agent represented by aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, color development is usually performed after black-and-white development is performed. As a black-and-white developer, well-known black-and-white developing agents, e.g., a dihydroxybenzene such as hydroquinone, a 3-pyrazolidone such as 1-phenyl-3-pyrazolidone, and an aminophenyl such as N-methyl-p-aminophenol can be used singly or in combination of two or more types thereof. The pH of the color and black-and-white developers is generally 9 to 12. Although the quantity of replenisher of these developers depends on a color photographic sensitive material to be processed, it is generally 3 L (liter) or less per $m^2$ of the sensitive material. The quantity of replenisher can be decreased to 500 mL or less by decreasing the bromide ion concentration in the replenisher. In order to decrease the quantity of replenisher, the contact area of a processing tank with air is preferably decreased to prevent evaporation and oxidation of the replenisher by air.

The processing effect resulting from the contact between the photographic processing solution and air in the processing tank can be evaluated by an aperture (=[contact area ($cm^2$) between processing solution and air]÷[volume ($cm^3$) of processing solution]). This aperture is preferably 0.1 or less, and more preferably 0.001 to 0.05. In order to reduce the aperture, a shielding member such as a floating cover can be provided on the liquid surface of the photographic processing solution in the processing tank. In addition, a method of using a movable cover described in JP-A-1-82033 or a slit developing method descried in JP-A-63-216050 can be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using means for suppressing storage of bromide ions in the developing solution.

The color development time is normally two to five minutes. The processing time, however, can be shortened by setting a high temperature and a high pH and using the color developing agent at a high concentration.

The color-developed photographic emulsion layer is generally bleached. Bleaching can be performed either simultaneously with fixing (bleach-fixing) or independently thereof. In addition, in order to increase the processing speed, bleach-fixing can be performed after bleaching. Also, processing can be performed in a bleach-fixing bath having two continuous tanks, fixing can be performed before bleach-fixing, or bleaching can be performed after bleach-fixing, according to the intended use. Examples of the bleaching agent are a compound of a multivalent metal such as iron(III), peroxides, quinones, and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase the processing speed and prevent the environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, the processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, DE1,290,812, DE2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in DE1,127,715 and JP-A-58-16235; polyoxyethylene compounds descried in DE966,410 and DE2,748,430; a polyamine compound described in JP-B-45-8836; compounds descried in JP-A-49-40943, JP-A-49-59644, JP-A-

53-94927, JP-A-54-35727, JP-A-55-26506, and JP-A-58-163940; and bromide ion. Of these compounds, a compound having a mercapto group or a disulfide group is preferable since the compound has a large accelerating effect. In particular, compounds described in U.S. Pat. No. 3,893,858, DE1,290,812, and JP-A-53-95630 are preferred. A compound described in U.S. Pat. No. 4,552,834 is also preferable. These bleaching accelerators can be added in the sensitive material. These bleaching accelerators are useful especially in bleach-fixing of a photographic color sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent are a thiosulfate, a thiocyanate, a thioether-based compound, thioureas, and a large amount of an iodide. Of these compounds, a thiosulfate is generally used, and especially ammonium thiosulfate can be used in the widest range of applications. In addition, a combination of a thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP294769A is preferred. In addition, in order to stabilize the fixing solution or the bleach-fixing solution, various types of aminopolycarboxylic acids or organic phosphonic acids are preferably added to the solution.

In the present invention, a compound having a pKa of 6.0 to 9.0 in concentrations of 0.1 to 10 mol/L of the fixing solution or the bleach-fixing solution are preferably added to the solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably 35° C. to 45° C. Within the preferable temperature range, the desilvering speed increases, and generation of a stain after the processing can be effectively prevented.

In the desilvering step, stirring is preferably as strong as possible. Examples of a method of strengthening the stirring are a method of colliding a jet stream of the processing solution against the emulsion surface of the sensitive material described in JP-A-62-183460, a method of increasing the stirring effect using rotating means described in JP-A-62-183461, a method of moving the sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective, e.g., can significantly increase the accelerating speed or eliminate fixing interference caused by the bleaching accelerator when the bleaching accelerator is used.

An automatic processor for processing a sensitive material of the present invention preferably has a sensitive material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially the processing time in each processing step and reduces the processing solution replenishing amount.

The sensitive material of the present invention is normally subjected to washing and/or stabilizing steps after desilvering. An amount of water used in the washing step can be arbitrarily determined over a broad range in accordance with the properties (e.g., a property determined by use of a coupler) of the sensitive material, the intended use of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248-253 (May, 1955). According to the above-described multi-stage counter-current scheme, the amount of water used for washing can be greatly decreased. Since washing water stays in the tanks for a long period of time, however, bacteria multiply and floating substances can be undesirably attached to the sensitive material. In order to solve this problem in the process of the color photographic sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic sensitive material of the present invention is 4 to 9, and preferably 5 to 8. The water temperature and the washing time can vary in accordance with the properties and the intended use of the sensitive material. Normally, the washing time is 20 seconds to 10 minutes at a temperature of 15° C. to 45° C., and preferably 30 seconds to 5 minutes at 25° C. to 40° C. A sensitive material of the present invention can be processed directly by a stabilizing agent in place of washing. All known methods described in JP-A-57-8543, JP-A-58-14834, and JP-A-60-220345 can be used in such stabilization processing.

Stabilization is sometimes performed subsequently to washing. One example is a stabilizing bath containing a dye stabilizing agent and a surface-active agent to be used as a final bath of the photographic color sensitive material. Examples of the dye stabilizing agent are an aldehyde such as formalin and glutaraldehyde, an N-methylol compound, hexamethylenetetramine, and an aldehyde sulfurous acid adduct. Various chelating agents or antifungal agents can be added to the stabilizing bath.

An overflow solution produced upon washing and/or replenishment of the stabilizing solution can be reused in another step such as a desilvering step.

In the processing using an automatic processor or the like, if each processing solution described above is condensed by evaporation, water is preferably added to correct condensation.

The silver halide color sensitive material of the present invention can contain a color developing agent in order to simplify processing and increase the processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

A sensitive material of the present invention can contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing can be accelerated at a higher temperature to shorten the processing time, or the image quality or stability of a processing solution can be improved at a lower temperature.

Various additives and developing methods are not particularly limited when the present invention is applied to black-and-white sensitive materials. For example, additives and methods described in the following portions of JP-A-2-68539, JP-A-5-11389, and JP-A-2-58041 can be preferably used.

1. Silver halide emulsions and manufacturing methods: JP-A-2-68539, page 8, lower right column, line 6 from the bottom to page 10, upper right column, line 12.

2. Chemical sensitization methods: JP-A-2-68539, page 10, upper right column, line 13 to lower left column, line 16, and a selenium sensitization method described in JP-A-5-11389.

3. Antifoggants and stabilizers: JP-A-2-68539, page 10, lower left column, line 17 to page 11, upper left column, line 7 and page 3, lower left column, line 2 to page 4, lower left column.

4. Spectral sensitizing dyes: JP-A-2-68539, page 4, lower right column, line 4 to page 8, lower right column and JP-A-2-58041, page 12, lower left column, line 8 to lower right column, line 19.

5. Surfactants and antistatic agents: JP-A-2-68539, page 11, upper left column, line 14 to page 12, upper left column, line 9 and JP-A-2-58041, page 2, lower left column, line 14 to page 5, line 12.

6. Matting agents, plasticizers, and slip agents: JP-A-2-68539, page 12, upper left column, line 10 to upper right column, line 10 and JP-A-2-58041, page 5, lower left column, line 13 to page 10, lower left column, line 3.

7. Hydrophilic colloids: JP-A-2-68539, page 12, upper right column, line 11 to lower left column, line 16.

8. Film hardeners: JP-A-2-68539, page 12, lower left column, line 17 to page 13, upper right column, line 6.

9. Development methods: JP-A-2-68539, page 15, upper left column, line 14 to lower left column, line 13.

The present invention is also applicable to heat development sensitive materials described in, e.g., U.S. Pat. No. 4,500,626, JP-A-60-133449, JP-A-59-218443, JP-A-61-238056, and EP210,660A2.

A silver halide sensitive material carrying magnetic recording layer and usable in the present invention can be any material provided that the material has a magnetic recording layer. This magnetic recording layer is formed adjacent to a support or formed via another photographic constituent layer.

The magnetic recording layer can also be a stripe layer described in JP-A-4-124642 or JP-A-4-124645.

As the magnetic recording layer, it is possible to use coating of ferromagnetic grains described in JP-A-59-23505, JP-A-4-195726, and JP-A-6-59357.

If this is the case, silver halide emulsions described in JP-A-4-166932, JP-A-3-41436, and JP-A-3-41437 can be used.

As a support, it is possible to use triacetate cellulose or polyethyleneterephthalate which is transparent and conventionally used in color films. However, the use of polyethylene aromatic dicarboxylate-based polyester supports is preferable in terms of magnetic recording characteristics. Polyethyleneterephthalate is particularly preferable among other polyethylene aromatic dicarboxylate-based polyester supports.

The thickness of this support is 50 to 300 $\mu$m, preferably 50 to 200 $\mu$m, more preferably 80 to 115 $\mu$m, and most preferably 85 to 105 $\mu$m.

As the support, it is preferable to use annealed polyester thin-film supports described in detail in JP-A-6-35118, JP-A-6-17528, and JIII Journal of Technical Disclosure No. 94-6023. More specifically, a support annealed at from 40° C. to a glass transition point for 1 to 1,500 hrs is preferable.

The above support can be further subjected to surface treatments such as ultraviolet radiation described in JP-B-43-2603, JP-B-43-2604, and JP-B-45-3828, corona discharge described in JP-B-48-5043 and JP-A-51-131576, and glow discharge described in JP-B-35-7578 and JP-B-46-43480. It is also possible to perform undercoating described in U.S. Pat. No. 5,326,689, form an underlayer described in U.S. Pat. No. 2,761,791 where necessary, and perform antistatic processing described in JP-A-4-62543 where necessary.

It is preferable to manufacture the above sensitive material by a manufacturing management method described in JP-B-4-86817 and record the manufacturing data by a method described in JP-B-6-87146. After or before that, the sensitive material is cut into a narrower film than the conventional 135 size in accordance with a method described in JP-A-4-125560. Two perforations are formed on each side of each small-format frame thus obtained such that the perforations match this small-format frame smaller than the conventional frames.

The resultant film can be used by placing it into a cartridge package described in JP-A-4-157459, a cartridge shown in FIG. 9 of an embodiment described in JP-A-5-210202, a film patrone described in U.S. Pat. No. 4,221,479, or a cartridge described in U.S. Pat. No. 4,834,308, U.S. Pat. No. 4,834,366, U.S. Pat. No. 5,226,613, or U.S. Pat. No. 4,846,418.

The film cartridge or film patrone herein used is preferably a type capable of accommodating the tongue of a film as described in U.S. Pat. No. 4,848,893 or U.S. Pat. No. 5,317,355 in respect of light-shielding properties.

It is more preferable to use a cartridge with a locking mechanism as described in U.S. Pat. No. 5,296,886, a cartridge displaying the use state described in U.S. Pat. No. 5,347,334, or a cartridge with a double exposure preventing function.

Also, as described in JP-A-6-85128, it is possible to use a cartridge by which a film is easily loaded by simply inserting the film into the cartridge.

A film cartridge thus manufactured can be purposefully used in photography, development, and various photographic pleasures by using cameras, processors, and laboratory machines described below.

For example, the function of a film cartridge (patrone) can be well achieved by using an easy-loading camera described in JP-A-6-8886 or JP-A-6-99908, an auto-winding camera described in JP-A-6-57398 or JP-A-6-101135, a camera described in JP-A-6-205690 by which a film can be unloaded and replaced during photography, a camera described in JP-A-5-283382 by which the information of photography such as panorama photography, Hivision photography, or normal photography can be magnetically recorded on a film (i.e., the printing aspect ratio is selectable and magnetically recordable), a camera with a double exposure preventing function described in JP-A-6-101194, and a camera with a function of displaying the use state of a film or the like described in JP-A-5-150577.

A photographed film can be processed by an automatic processor described in JP-A-6-222514 or JP-A-6-222545. Alternatively, before, during, or after the processing it is possible to use a method of using magnetically recorded information on a film described in JP-A-6-95265 or JP-A-4-123054 or use an aspect ratio selecting function described in JP-A-5-19364.

If the development is motion picture type development, films are spliced by a method described in JP-A-5-119461.

During or after the development, attaching and detaching described in JP-A-6-148805 are performed.

After the above processes, film information can also be changed to a print through back printing or front printing to color paper described in JP-A-2-184835, JP-A-4-186335, or JP-A-6-79968.

Furthermore, a film can be returned to the customer with an index print described in JP-A-5-11353 or JP-A-5-232594 and a return cartridge.

EXAMPLES

The present invention will be described in detail below by way of its examples, but the invention is not limited to these examples.

Example 1

(1) Preparation of Emulsions (Preparation of Emulsion 1-A)

1) 1.6L (liter) of an aqueous solution containing 0.3 g of KBr and 0.5 g of gelatin with an average molecular weight of 15,000 was maintained at a temperature of 35° C. and pBr=2.8.

2) To this aqueous solution with stirring, 30 mL of an aqueous silver nitrate solution (containing 5.0 g of silver nitrate in 100 mL) and 30 mL of an aqueous potassium bromide solution (containing 3.5 g of potassium bromide in 100 mL) were simultaneously added at a flow rate of 45 mL/min by the double-jet method.

3) Immediately after the addition, 2.2 g of potassium bromide and delimed gelatin were added, and ripening was performed by raising the temperature to 75° C.

4) When 70 minutes elapsed after the addition of silver nitrate, an aqueous silver nitrate solution (containing 20.0 g of silver nitrate in 100 mL) and an aqueous halogen solution (containing 14.3 g of potassium bromide and 1.25 g of potassium iodide in 100 mL) were again added at an accelerated flow rate over 30 min, while the silver potential was held at −30 mV with respect to the saturated calomel electrode. To this point, 57% of the total silver nitrate amount were consumed.

5) Subsequently, an aqueous silver nitrate solution (containing 20.0 g of silver nitrate in 100 mL) and an aqueous halogen solution (containing 14.3 g of potassium bromide in 100 mL) were added at −20 mV. To this point, 70% of the total silver amount were consumed.

6) An aqueous silver nitrate solution (containing 14.2 g of silver nitrate in 100 mL) and an aqueous potassium bromide solution (containing 22.4 g of potassium bromide in 100 mL) were added over 4 min by the double-jet method. To this point, 69% of the total silver nitrate amount were consumed.

7) After that, an aqueous silver nitrate solution (containing 32.0 g of silver nitrate in 100 mL) and an aqueous potassium bromide solution (containing 22.4 g of potassium bromide in 100 mL) were again added over 16 min by the double-jet method while the pAg was held at 9.7. To this point, 212 g of silver nitrate were consumed.

8) The resultant emulsion was washed with water by the well-known flocculation method at 35° C., gelatin was added, and the emulsion was heated to 40° C.

9) After 10 minutes, the temperature was raised to 58° C., $5.5\times10^{-4}$, $8.0\times10^{-4}$, and $2.5\times10^{-5}$ mol/molAg of dyes ExS-1, ExS-3, and ExS-2 (to be presented later), respectively, $2.1\times10^{-5}$ mol/molAg of sodium thiosulfate, $2.0\times10^{-3}$ mol/molAg of potassium thiocyanate, and $4.1\times10^{-6}$ mol/molAg of chloroauric acid were added, and the emulsion was so ripened that the sensitivity was highest when exposure was performed for 1/100 sec. After that, $3.3\times10^{-4}$ mol/molAg of sodium 3-(5-mercaptotetrazole)-benzenesulfonate was added. This emulsion will be referred to as Em1-A hereinafter.

Em1-A was occupied by tabular grains having an equivalent-circle diameter of 0.6 μm or more, a thickness of 0.3 μm or less, an aspect ratio of 2 or more, in an amount of 80% (in number). The tabular grains were silver iodobromide (silver iodide content: 4 mol %; silver chloride content: 0%) having a variation coefficient of the grain diameter of 28%, an average equivalent-circle diameter of 1.34 μm, and an average thickness of 0.26 μm, and an average aspect ration of 5.

(Preparation of Emulsion 1-B)

A silver chloride-containing layer was formed by using an aqueous solution mixture of potassium bromide and sodium chloride, instead of the aqueous potassium bromide solution, in step 5) of Em1-A. The silver chloride content in this silver chloride-containing layer is shown in Table 1 (to be presented later). The grain shape was the same as the emulsion 1-A.

(Preparation of Emulsion 1-C)

In step 7) of Em1-A, $1\times10^{-5}$ mol/molAg of potassium hexacyanoruthenate was added with respect to the total silver amount when 80% of silver nitrate were consumed. The grain shape was the same as the emulsion 1-A.

(Preparation of Emulsions 1-D to 1-G)

Emulsions 1-D to 1-G were prepared following the preparation methods of Em1-B and Em1-C. The contents are shown in Table 1.

(Preparation of Emulsion 1-H)

A solution containing potassium bromide was used instead of the solution containing potassium iodide and potassium bromide used in step 4) of Em1-A. Additionally, grain formation was performed by using an aqueous solution containing the equal amount of potassium iodide as in step 4) instead of the potassium bromide solution used in step 6). Tabular grains having the same shape as Em1-A were prepared by changing the potential in step 4). The grains were observed with a transmission electron microscope, and it was found that dislocation lines were densely formed in the fringe of each grain.

The changes from the emulsion 1-A to the emulsion 1-H are shown in Table 1.

(2) Making and Evaluation of Coated Samples

Undercoated cellulose triacetate film supports were coated with emulsions and a protective layer shown in Table 1 in coating amounts shown in Table A below, thereby making coated samples 101 to 118.

TABLE A

| Emulsion coating conditions | | |
|---|---|---|
| (1) | Emulsion layer | |
| | Emulsion . . . several different emulsions | |
| | | (silver $3.6\times10^{-2}$ mol/m$^2$) |
| | Coupler | ($1.5\times10^{-3}$ mol/m$^2$) |

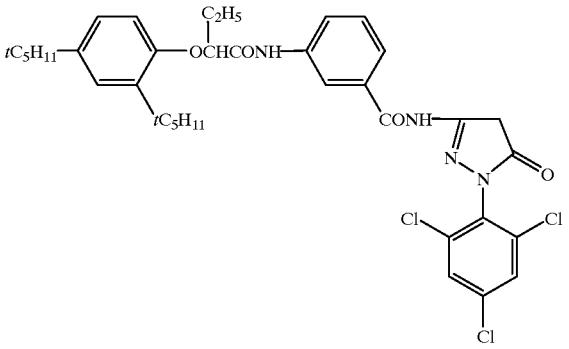

| | | |
|---|---|---|
| | Tricresylphosphate | (1.10 g/m$^2$) |
| | Gelatin | (2.30 g/m$^2$) |
| (2) | Protective layer | (0.08 g/m$^2$) |
| | 2,4-dichloro-6-hydroxy-s-triazine sodium salt | |
| | Gelatin | (1.80 g/m$^2$) |

These samples were left to stand at a temperature of 40° C. and a relative humidity of 70% for 14 hrs, exposed through a continuous wedge for 1/100 sec, and subjected to color development shown in Table B below.

The densities of the processed samples were measured through a green filter.

TABLE B

| Process | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The compositions of the processing solutions are shown below.

| | (g) |
|---|---|
| (Color developer) | |
| Diethylenetriaminepentaacetate | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 L |
| pH | 10.05 |
| (Bleach-fix bath) | |
| Ferric ammonium ethylenediamine-tetraacetate dihydrate | 90.0 |
| Sodium ethylenediaminetetraacetate | 5.0 |
| Sodium sulfite | 12.0 |
| Ammonium thiosulfate aqueous solution (70%) | 260.0 mL |
| Acetic acid (98%) | 5.0 mL |
| Bleaching accelerator | 0.01 mol |

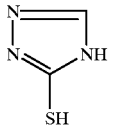

| | |
|---|---|
| Water to make | 1.0 L |
| pH | 6.0 |
| (Washing solution) | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuratedichloride and 1.5 g/L of sodium sulfate were added.

The pH of the solution ranged from 6.5 to 7.5.

| (Stabilizer) | (g) |
|---|---|
| Formalin (37%) | 2.0 mL |
| Polyoxyethylene-p-monononylphenylether (average polymerization degree = 10) | 0.3 |
| Disodium ethylenediaminetetraacetate | 0.05 |
| Water to make | 1.0 L |
| pH | 5.0–8.0 |

Sensitivity was expressed as a reciprocal of an amount of exposure giving a density of fog value+0.2. Granularity was measured by a conventional method.

The obtained results are summarized in Table 1 below.

TABLE 1

Advantages obtained by the presence of a specific silver chloride-containing layer and dislocation lines in doped emulsions

| Sample | Emulsion | Dislocation lines | Equivalent circular diameter | Variation coefficient | Aspect ratio | AgCl layer | Dopant | Used amount mol/molAg | Sensitivity | Graininess | Remarks |
|---|---|---|---|---|---|---|---|---|---|---|---|
| 101 | 1-A | Absent | 1.34 | 30% | 5 | Absent | Absent | | 100 | 100 | Comp. |
| 102 | 1-B | Absent | 1.34 | 30% | 5 | 3 mol % | Absent | | 102 | 98 | Comp. |
| 103 | 1-C | Absent | 1.34 | 30% | 5 | Absent | $[Ru(CN)_6]^{4-}$ | $1 \times 10^{-5}$ | 110 | 98 | Comp. |
| 104 | 1-D | Absent | 1.34 | 30% | 5 | 3 mol % | $[Ru(CN)_6]^{4-}$ | $1 \times 10^{-5}$ | 143 | 100 | Inv. |
| 105 | 1-E | Absent | 1.34 | 30% | 5 | 10 mol % | $[Ru(CN)_6]^{4-}$ | $1 \times 10^{-5}$ | 143 | 98 | Inv. |
| 106 | 1-F | Absent | 1.34 | 30% | 5 | 20 mol % | $[Ru(CN)_6]^{4-}$ | $1 \times 10^{-5}$ | 145 | 96 | Inv. |
| 107 | 1-G | Absent | 1.34 | 30% | 5 | 30 mol % | $[Ru(CN)_6]^{4-}$ | $1 \times 10^{-5}$ | 145 | 65 | Comp. |
| 108 | 1-H | Present | 1.34 | 30% | 5 | 3 mol % | $[Ru(CN)_6]^{4-}$ | $1 \times 10^{-5}$ | 178 | 100 | Inv. |

Sensitivity and granularity are expressed by relative values assuming those of Sample 101 as 100, respectively. The bigger the sensitivity value is, the higher the sensitivity. The bigger the granularity value is, the better granularity.

Comparison of the sample 101 with the sample 102 shows that the sensitivity remained almost unchanged when only the silver chloride layer was formed. On the other hand, comparing the sample 101 with the sample 103 indicates that the sensitivity was slightly raised by the addition of ruthenium.

The sensitivity, however, was greatly raised in the samples 104 to 106 using the both, indicating a significant effect of the present invention. Since the granularity did not degrade, this indicates that the development properties did not change and the quantum sensitivity of grains increased.

In the sample 107 outside the range of the present invention, in which the silver chloride content was further increased, the graininess degraded although the sensitivity was held. This demonstrates that the formation of a silver chloride layer within the range of the present invention is important.

The effect of the formation of dislocation lines can be evaluated by comparison of the sample 108 with the sample 104. It is obvious that the sensitivity is further increased by the formation of dislocation lines.

Example 2

Emulsions shown in Table 2 were prepared by using phthalized gelatin instead of the delimed gelatin in step 3) and adjusting the silver nitrate and halogen addition rates in steps 4) and 5) in the preparation of the emulsion 1-H in Example 1. The sensitivity and granularity of each resultant emulsion were evaluated following the same procedures as in Example 1.

TABLE 2

Advantages obtained by monodispersity

| Sample | Emulsion | Dislocation lines | Equivalent circular diameter | Variation coefficient | Aspect ratio | AgCl layer | Dopant | Used amount mol/molAg | Sensitivity | Graininess | Remarks |
|---|---|---|---|---|---|---|---|---|---|---|---|
| 201 | 1-H | Present | 1.34 | 30% | 5 | 10 mol % | $[Ru(CN)_6]^{4-}$ | $1 \times 10^{-5}$ | 100 | 100 | Inv. |
| 202 | 2-A | Present | 1.34 | 26% | 5 | 10 mol % | $[Ru(CN)_6]^{4-}$ | $1 \times 10^{-5}$ | 100 | 100 | Inv. |
| 203 | 2-B | Present | 1.34 | 24% | 5 | 10 mol % | $[Ru(CN)_6]^{4-}$ | $1 \times 10^{-5}$ | 130 | 125 | Inv. |
| 204 | 2-C | Present | 1.34 | 20% | 5 | 10 mol % | $[Ru(CN)_6]^{4-}$ | $1 \times 10^{-5}$ | 135 | 130 | Inv. |

Sensitivity and granularity are expressed by relative values assuming those of Sample 101 as 100, respectively. The bigger the sensitivity value is, the higher sensitivity. The bigger the granularity value is, the better granularity.

When the variation coefficient becomes 24%, both the graininess and sensitivity largely increased. This indicates that the monodispersity is a crucial factor in an emulsion containing a silver chloride layer such as the emulsions of the present invention.

Example 3

Emulsions were prepared by changing the aspect ratio as shown in Table 3 by changing the silver chloride layer, dopant, gelatin type, and growth potential in the preparation steps of the emulsion 2-B in Example 2. The amounts of after-ripening chemicals were adjusted such that the 1/100 sensitivity was highest.

The sensitivity and granularity of each resultant emulsion were evaluated following the same procedures as in Example 1. The results are shown in Table 3 below.

TABLE 3

Advantages obtained by applying a specific aspect ratio to emulsions, to which silver chloride-containing layer is provided and a dopant is added.

| Sample | Emulsion | Dislocation lines | Equivalent circular diameter | Variation coefficient | Aspect ratio | AgCl layer | Dopant | Used amount mol/molAg | Sensitivity | Graininess | Remarks |
|---|---|---|---|---|---|---|---|---|---|---|---|
| 301 | 3-A | Present | 1.34 | 24% | 5 | Absent | Absent | | 100 | 100 | Comp. |
| 302 | 3-B | Present | 1.34 | 24% | 5 | 3 mol % | Absent | | 100 | 100 | Comp. |
| 303 | 3-C | Present | 1.34 | 24% | 5 | Absent | $[Ru(CN)_6]^{4-}$ | $1 \times 10^{-5}$ | 110 | 100 | Comp. |
| 304 | 3-D | Present | 1.34 | 24% | 5 | 3 mol % | $[Ru(CN)_6]^{4-}$ | $1 \times 10^{-5}$ | 140 | 100 | Inv. |
| 305 | 3-E | Present | 1.56 | 24% | 8 | Absent | Absent | | 105 | 100 | Comp. |
| 306 | 3-F | Present | 1.56 | 24% | 8 | 3 mol % | Absent | | 105 | 100 | Comp. |
| 307 | 3-G | Present | 1.56 | 24% | 8 | Absent | $[Ru(CN)_6]^{4-}$ | $1 \times 10^{-5}$ | 115 | 100 | Comp. |
| 308 | 3-H | Present | 1.56 | 24% | 8 | 3 mol % | $[Ru(CN)_6]^{4-}$ | $1 \times 10^{-5}$ | 160 | 100 | Inv. |
| 309 | 3-I | Present | 2.13 | 24% | 20 | Absent | Absent | | 110 | 100 | Comp. |
| 310 | 3-J | Present | 2.13 | 24% | 20 | 3 mol % | Absent | | 110 | 100 | Comp. |
| 311 | 3-K | Present | 2.13 | 24% | 20 | Absent | $[Ru(CN)_6]^{4-}$ | $1 \times 10^{-5}$ | 120 | 100 | Comp. |
| 312 | 3-L | Present | 2.13 | 24% | 20 | 3 mol % | $[Ru(CN)_6]^{4-}$ | $1 \times 10^{-5}$ | 200 | 100 | Inv. |

Sensitivity and granularity are expressed by relative values assuming those of Sample 101 as 100, respectively. The bigger the sensitivity value is, the higher sensitivity. The bigger the granularity value is, the better granularity.

As can be seen from the comparison of the samples 301, 305, and 309, the sensitivity rose when the aspect ratio was raised. However, this sensitivity rise was small. This is also indicated by the comparison of the samples 302, 306, and 310 or the comparison of the samples 303, 307, and 311. However, the comparison of the samples 304, 308, and 312 of the present invention shows that the sensitivity rise was very large when the aspect ratio was raised. That is, the effect of the present invention is particularly notable when the aspect ratio is raised.

Example 4

1) Support

A support used in this example was formed as follows.

100 parts by weight of a polyethylene-2,6-naphthalate polymer and 2 parts by weight of Tinuvin P. 326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec. The result was a 90-μm thick PEN film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hrs, manufacturing a support with a high resistance to curling.

2) Coating of Undercoat Layer

The two surfaces of the support were subjected to corona discharge, UV discharge, and glow discharge and coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, forming an undercoat layer on a side at a higher temperature upon orientation. Drying was performed at 115° C. for 6 min (all rollers and conveyors in the drying zone were at 115° C.).

3) Coating of Back Layers

On the other surface of the undercoated support, an antistatic layer, a magnetic recording layer, and a slip layer having the following compositions were coated as back layers.

3-1) Coating of Antistatic Layer 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm was coated together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and 0.22 g/m$^2$ of resorcin.

3-2) Coating of Magnetic Recording Layer 0.06 g/m$^2$ of cobalt-γ-iron oxide (specific area 43 m$^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-polyoxyethylene-propyloxytrimethoxysilane (polymerization degree 15, 15 wt %) was coated by a bar coater together with 1.2 g/m$^2$ of diacetylcellulose (iron oxide was dispersed by an open kneader and a sand mill) by using 0.3 g/m$^2$ of $C_2H_5C(CH_2OCONH{-}C_6H_3(CH_3)NCO)_3$ as a hardener and acetone, methylethylketone, and cyclohexane as solvents, forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-polyoxyethylene-propyloxytrimethoxysilane (polymerization degree 15, 15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 emu/g, $7.3\times10^4$ A/m, and 65%, respectively.

3-3) Preparation of Slip Layer

Diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$) were coated. Note that this mixture was melted in xylene/propyleneglycolmonomethylether (1/1) at 105° C., dispersed in propyleneglycolmonomethylether (tenfold amount), and formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-polyoxyethylene-propyloxytrimethoxysiliane (polymerization degree 15, 15 wt %) were added as a polishing agent. Drying was performed at 115° C. for 6 min (all rollers and conveyors in the drying zone were at 115° C.). The resultant slip layer was found to have excellent characteristics. That is, the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

On the side opposite to the back layers formed as above against the support, a plurality of layers having the following compositions were coated to manufacture a color negative film. This film will be referred to as a sample 401 hereinafter.

(Compositions of Sensitive Layers)

The main materials used in the individual layers are classified as follows.

| | | | |
|---|---|---|---|
| ExC: | Cyan coupler | UV: | Ultraviolet absorbent |
| ExM: | Magenta coupler | HBS: | High-boiling organic solvent |
| ExY: | Yellow coupler | H: | Gelatin hardener |
| ExS: | Sensitizing dye | | |

The number corresponding to each component indicates the coating amount in units of g/m$^2$. The coating amount of a silver halide is represented by the amount of silver. The coating amount of each sensitizing dye is represented in units of mols per 1 mol of a silver halide in the same layer.

| | | |
|---|---|---|
| 1st layer (1st antihalation layer) | | |
| Black colloidal silver | silver | 0.08 |
| Gelatin | | 0.70 |
| 2nd layer (2nd antihalation layer) | | |
| Black colloidal silver | silver | 0.09 |
| Gelatin | | 1.00 |
| ExM-1 | | 0.12 |
| ExF-1 | | $2.0 \times 10^{-3}$ |
| Solid dispersd dye ExF-2 | | 0.030 |
| Solid dispersd dye ExF-3 | | 0.040 |
| HBS-1 | | 0.15 |
| HBS-2 | | 0.02 |
| 3rd layer (Interlayer) | | |
| Silver iodobromide emulsion N | silver | 0.06 |
| ExC-2 | | 0.05 |
| Polyethylacrylate latex | | 0.20 |
| Gelatin | | 0.70 |
| 4th layer (Low-speed red-sensitive emulsion layer) | | |
| Silver iodobromide emulsion A | silver | 0.07 |
| Silver iodobromide emulsion B | silver | 0.28 |
| ExS-1 | | $3.3 \times 10^{-4}$ |
| ExS-2 | | $1.4 \times 10^{-5}$ |
| ExS-3 | | $4.6 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 1.10 |
| 5th layer (Medium-speed red-sensitive emulsion layer) | | |
| Silver iodobromide emulsion C | silver | 0.70 |
| ExS-1 | | $4.2 \times 10^{-4}$ |
| ExS-2 | | $1.8 \times 10^{-5}$ |
| ExS-3 | | $5.9 \times 10^{-4}$ |
| ExC-1 | | 0.12 |
| ExC-2 | | 0.04 |
| ExC-3 | | 0.05 |
| ExC-4 | | 0.08 |
| ExC-5 | | 0.02 |
| ExC-6 | | 0.015 |
| Cpd-4 | | 0.02 |
| Cpd-2 | | 0.02 |
| HBS-1 | | 0.10 |

-continued

| | | |
|---|---|---|
| Gelatin | | 0.80 |
| 6th layer (High-speed red-sensitive emulsion layer) | | |
| Silver iodobromide emulsion D | silver | 0.90 |
| ExS-1 | | $3.5 \times 10^{-4}$ |
| ExS-2 | | $1.5 \times 10^{-5}$ |
| ExS-3 | | $4.9 \times 10^{-4}$ |
| ExC-1 | | 0.05 |
| ExC-3 | | 0.03 |
| ExC-6 | | 0.020 |
| ExC-7 | | 0.010 |
| Cpd-2 | | 0.040 |
| Cpd-4 | | 0.040 |
| HBS-1 | | 0.22 |
| HBS-2 | | 0.050 |
| Gelatin | | 1.10 |
| 7th layer (Interlayer) | | |
| Cpd-1 | | 0.060 |
| Solid dispersd dye ExF-4 | | 0.030 |
| HBS-1 | | 0.040 |
| Polyethylacrylate latex | | 0.15 |
| Gelatin | | 1.10 |
| 8th layer (Low-speed green-sensitive emulsion layer) | | |
| Silver iodobromide emulsion E | silver | 0.27 |
| Silver iodobromide emulsion F | silver | 0.22 |
| Silver iodobromide emulsion G | silver | 0.16 |
| ExS-7 | | $7.5 \times 10^{-4}$ |
| ExS-8 | | $3.4 \times 10^{-4}$ |
| ExS-4 | | $2.5 \times 10^{-5}$ |
| ExS-5 | | $9.0 \times 10^{-5}$ |
| ExS-6 | | $4.3 \times 10^{-4}$ |
| ExM-3 | | 0.22 |
| ExM-4 | | 0.07 |
| ExY-1 | | 0.01 |
| ExY-5 | | 0.0020 |
| HBS-1 | | 0.30 |
| HBS-3 | | 0.015 |
| Cpd-4 | | 0.010 |
| Gelatin | | 0.95 |
| 9th layer (Medium-speed green-sensitive emulsion layer) | | |
| Silver iodobromide emulsion G | silver | 0.45 |
| Silver iodobromide emulsion H | silver | 0.35 |
| ExS-4 | | $3.6 \times 10^{-5}$ |
| ExS-7 | | $1.7 \times 10^{-4}$ |
| ExS-8 | | $8.0 \times 10^{-4}$ |
| ExC-8 | | 0.0020 |
| ExM-3 | | 0.193 |
| ExM-4 | | 0.05 |
| ExY-1 | | 0.015 |
| ExY-4 | | 0.005 |
| ExY-5 | | 0.002 |
| Cpd-4 | | 0.015 |
| HBS-1 | | 0.13 |
| HBS-3 | | $4.4 \times 10^{-3}$ |
| Gelatin | | 0.80 |
| 10th layer (High-speed green-sensitive emulsion layer) | | |
| Silver iodobromide emulsion I | silver | 1.40 |
| ExS-4 | | $6.3 \times 10^{-5}$ |
| ExS-7 | | $1.7 \times 10^{-4}$ |
| ExS-8 | | $7.8 \times 10^{-4}$ |
| ExC-6 | | 0.01 |
| ExM-4 | | 0.005 |
| ExM-2 | | 0.020 |
| ExM-5 | | 0.001 |
| ExM-6 | | 0.001 |
| ExM-3 | | 0.02 |
| Cpd-3 | | 0.001 |
| Cpd-4 | | 0.040 |
| HBS-1 | | 0.25 |
| Polyethylacrylate latex | | 0.15 |
| Gelatin | | 1.33 |
| 11th layer (Yellow filter layer) | | |
| Yellow colloidal silver | silver | 0.015 |
| Cpd-1 | | 0.16 |

-continued

| | |
|---|---|
| Solid dispersd dye ExF-5 | 0.060 |
| Solid dispersd dye ExF-6 | 0.060 |
| Oil-soluble dye ExF-7 | 0.010 |
| HBS-1 | 0.60 |
| Gelatin | 0.60 |
| 12th layer (Low-speed blue-sensitive emulsion layer) | |
| Silver iodobromide emulsion J | silver 0.07 |
| Silver iodobromide emulsion K | silver 0.13 |
| Silver iodobromide emulsion L | silver 0.19 |
| ExS-9 | $8.4 \times 10^{-4}$ |
| ExC-1 | 0.03 |
| ExC-8 | $7.0 \times 10^{-3}$ |
| ExY-1 | 0.060 |
| ExY-2 | 0.75 |
| ExY-3 | 0.40 |

-continued

| | |
|---|---|
| ExY-4 | 0.040 |
| Cpd-2 | 0.005 |
| Cpd-4 | 0.005 |
| Cpd-3 | 0.004 |
| HBS-1 | 0.28 |
| Gelatin | 2.60 |
| 13th layer (High-speed blue-sensitive emulsion layer) | |
| Silver iodobromide emulsion M | silver 0.37 |
| ExS-9 | $6.0 \times 10^{-4}$ |
| ExY-2 | 0.070 |
| ExY-3 | 0.020 |
| ExY-4 | 0.0050 |
| Cpd-2 | 0.10 |
| Cpd-3 | $1.0 \times 10^{-3}$ |
| Cpd-4 | $5.0 \times 10^{-3}$ |
| HBS-1 | 0.075 |
| Gelatin | 0.55 |
| 14th layer (1st protective layer) | |
| Silver iodobromide emulsion N | silver 0.10 |
| UV-1 | 0.13 |
| UV-2 | 0.10 |
| UV-3 | 0.16 |
| UV-4 | 0.025 |
| ExF-8 | 0.03 |

-continued

| | |
|---|---|
| ExF-9 | 0.005 |
| ExF-10 | 0.005 |
| ExF-11 | 0.02 |
| HBS-1 | $5.0 \times 10^{-2}$ |
| HBS-4 | $5.0 \times 10^{-2}$ |
| Gelatin | 1.8 |
| 15th layer (2nd protective layer) | |
| H-1 | 0.40 |
| B-1 (diameter 1.7 μm) | 0.04 |
| B-2 (diameter 1.7 μm) | 0.09 |
| B-3 | 0.13 |
| ES-1 | 0.20 |
| Gelatin | 0.70 |

In addition to the above components, to improve the storage stability, processability, resistance to pressure, antiseptic and mildewproofing properties, antistatic properties, and coating properties, the individual layers contained W-1 to W-3, B-4 to B-6, F-1 to F-18, iron salt, lead salt, gold salt, platinum salt, palladium salt, iridium salt, and rhodium salt.

TABLE 4

| Emulsion | Average AgI content (%) | Average grain size Equivalent spherical diameter (μm) | Variation coefficient of grain size (%) | Projected area size Equivalent circular diameter (μm) | Diameter/ thickness ratio | Tabularity |
|---|---|---|---|---|---|---|
| A | 3.7 | 0.37 | 13 | 0.43 | 2.3 | 12 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 3.7 | 0.37 | 13 | 0.43 | 2.3 | 12 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 5.4 | 0.72 | 23 | 1.10 | 6.3 | 36 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.8 | 0.88 | 30 | 1.12 | 4.7 | 20 |
| N | 1.0 | 0.07 | — | — | 1.0 | — |

In Table 4, (1) The emulsions J to M were subjected to reduction sensitization during grain adjustment by using thiourea dioxide and thiosulfonic acid in accordance with Example in U.S. Pat. No. 5,061,614.

(2) The emulsions C to I and M were subjected to gold sensitization, sulfur sensitization, and selenium sensitization in the presence of the spectral sensitizing dyes described in the individual sensitive layers and sodium thiocyanate in accordance with embodiments in EP443,453A.

(3) The tabular grains were prepared by using low-molecular weight gelatin in accordance with Example in JP-A-1-158426.

(4) Dislocation lines as described in EP443,453A were observed in the tabular grains when a high-voltage electron microscope was used.

(5) The emulsions A to E, G, H, and J to M contained optimum amounts of Rh, Ir, and Fe.

Also, letting Dc be the average equivalent-circle diameter of the projected areas of tabular grains and t be the average thickness of the tabular grains, the flatness is defined by $Dc/t^2$.

Preparation of Dispersions of Organic Solid Dispersd Dyes

ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hours. This dispersion was done by using a BO type oscillating ball mill manufactured by Chuo Koki K.K. The dispersion was removed from the mill and added to 8 g of a 12.5% aqueous solution of gelatin. The beads were removed from the resultant material by filtration, obtaining a gelatin dispersion of the dye. The average grain size of the fine dye grains was 0.44 μm.

Following the same procedure as above, solid dispersions of ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of EP549, 489A. The average grain size was found to be 0.06 μm.

ExC-1

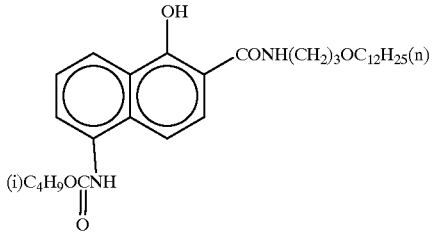

ExC-2

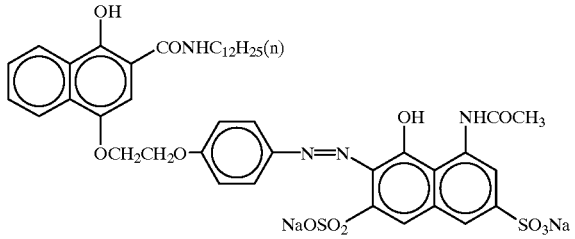

ExC-3

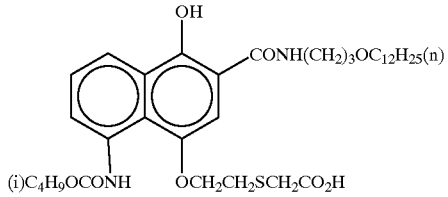

ExC-4

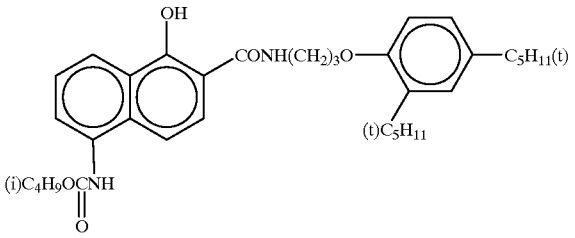

ExC-5

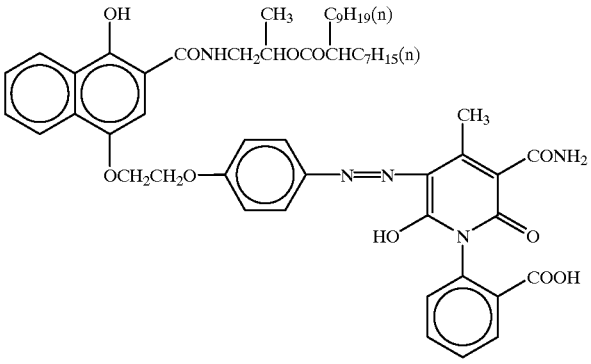

ExC-6

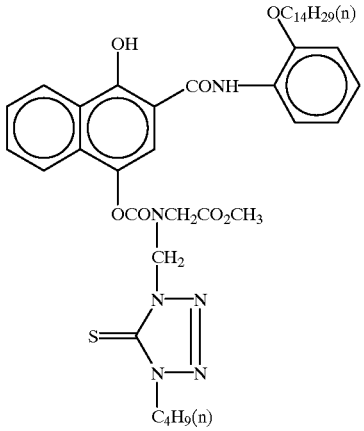

-continued
ExC-7
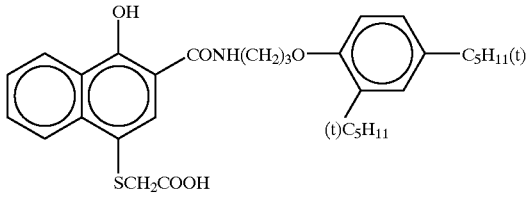
ExC-8
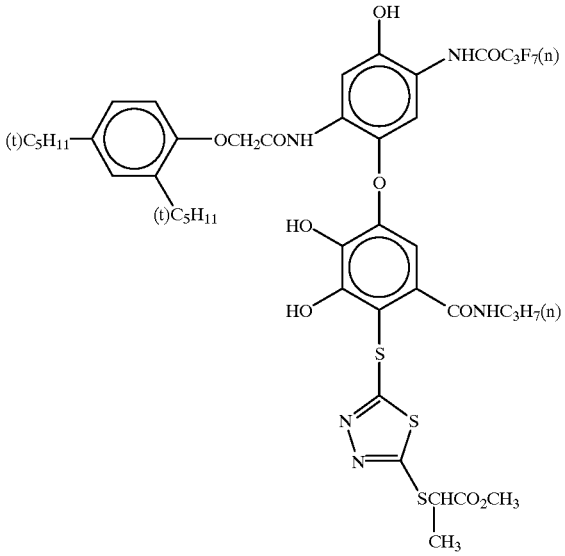
ExM-1
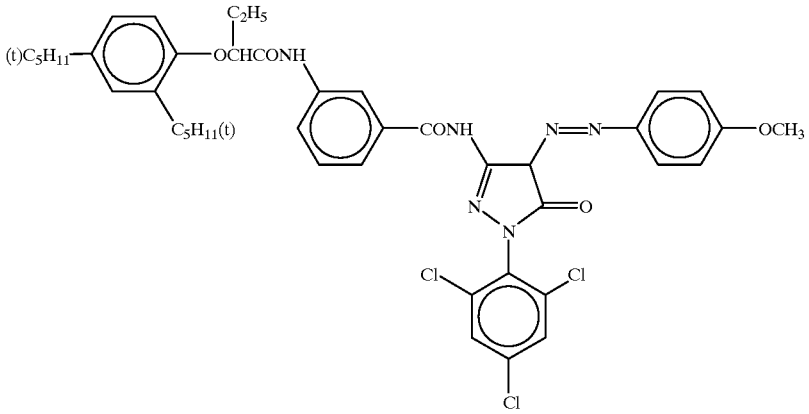
ExM-2
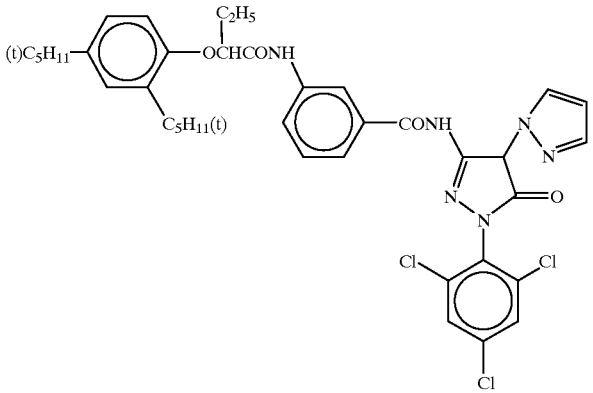

-continued
ExM-3
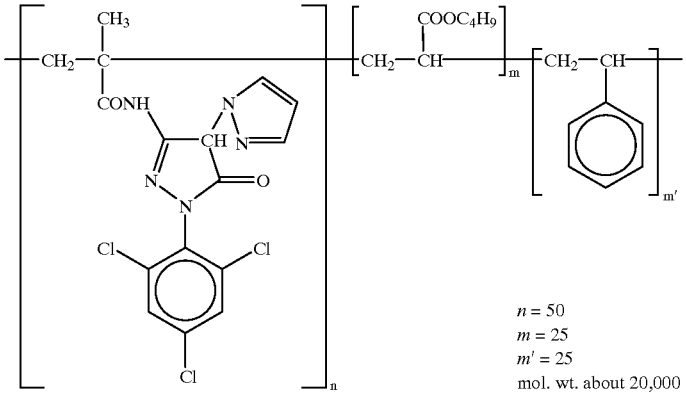
ExM-4
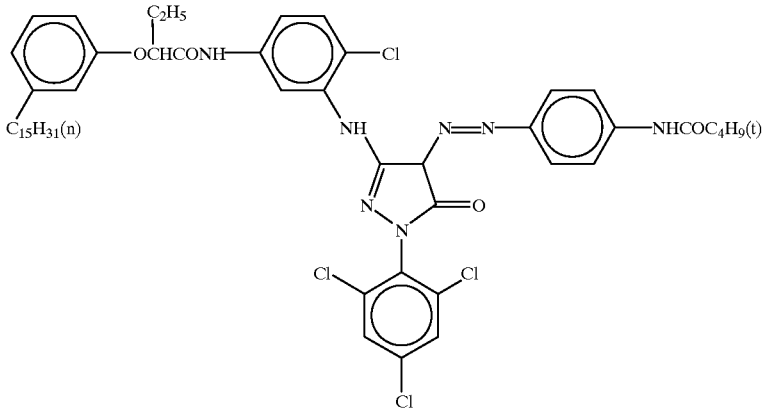
ExM-5
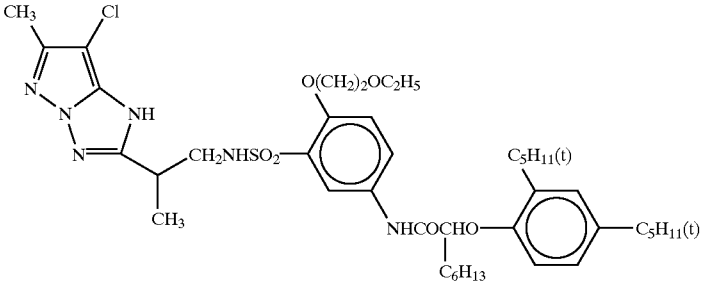
ExM-6
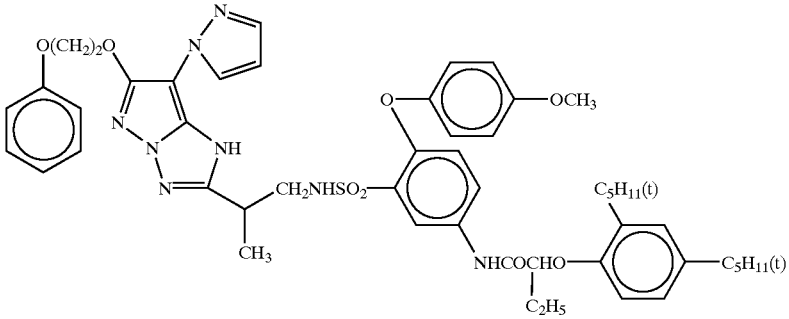

-continued
ExY-1
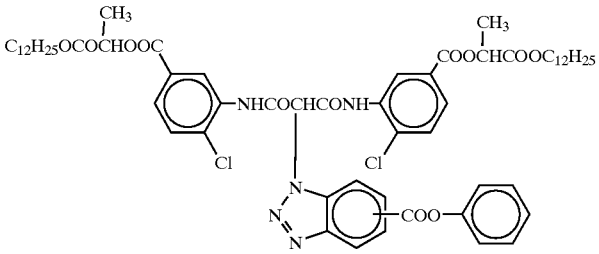
ExY-2
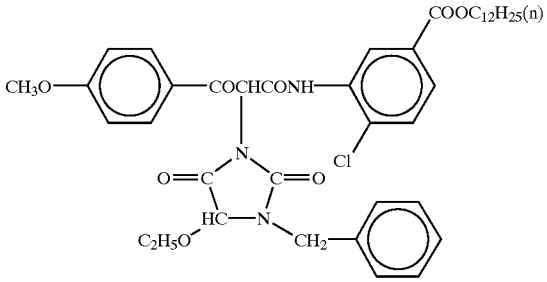
ExY-3
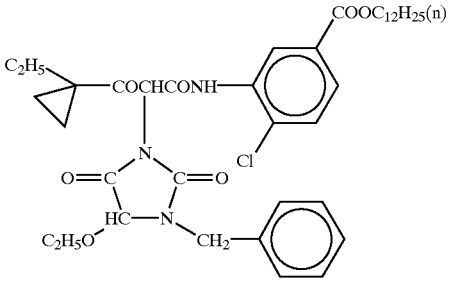
ExY-4
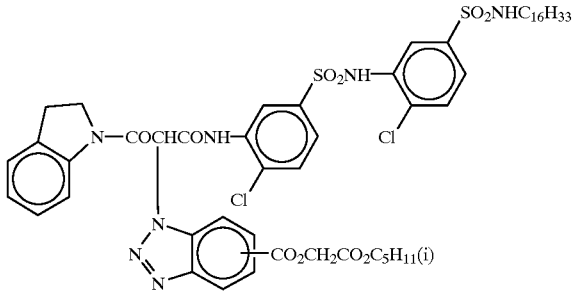
ExY-5
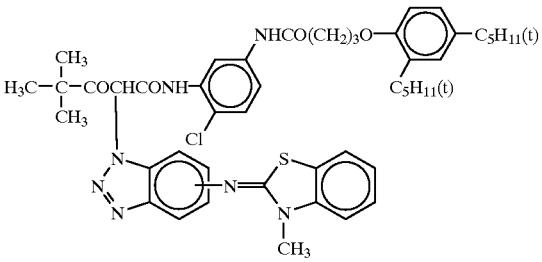
ExF-1
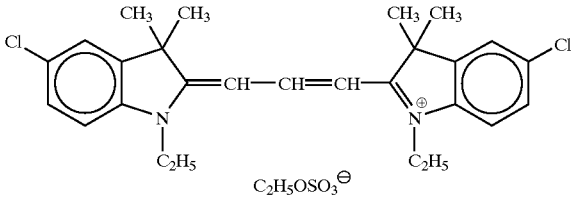
ExF-2
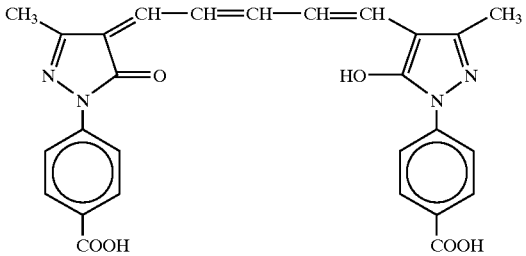
ExF-3
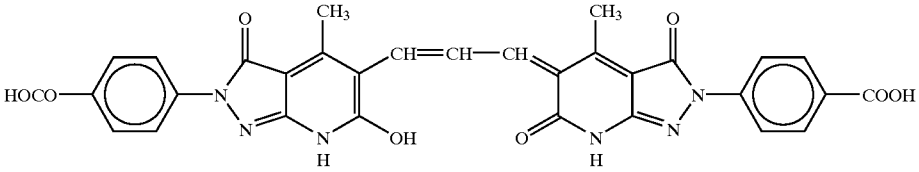

-continued
ExF-4
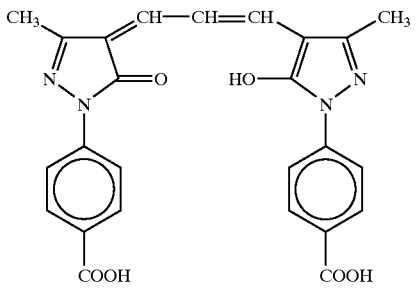
ExF-5
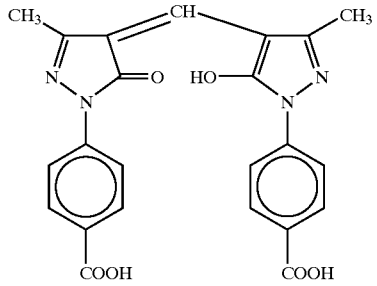
ExF-6
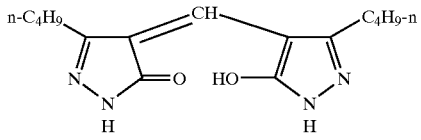
ExF-7
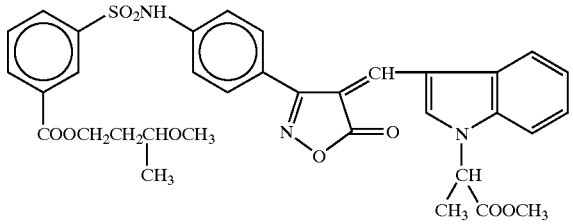
ExF-8
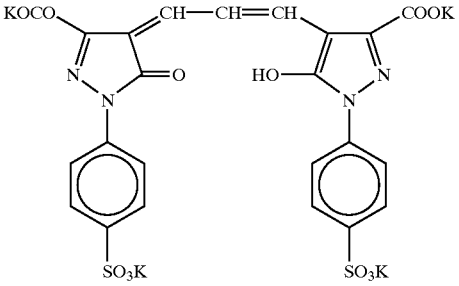
ExF-9
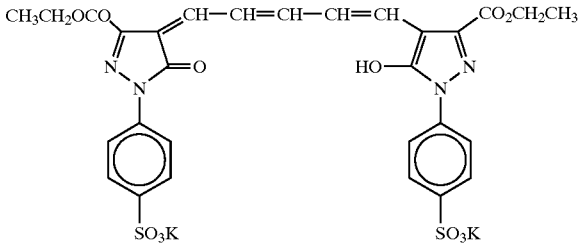
ExF-10
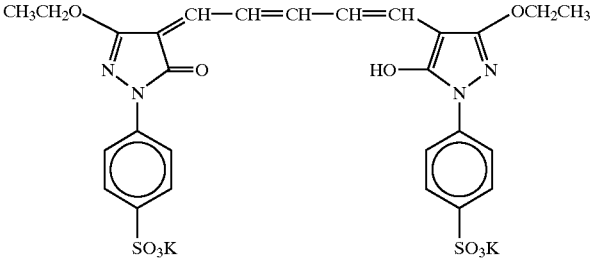
ExF-11
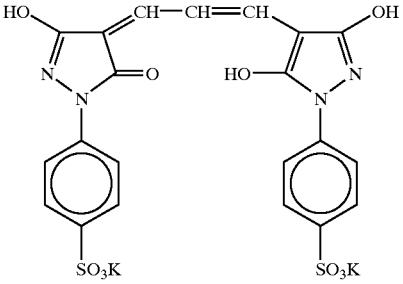
Cpd-1
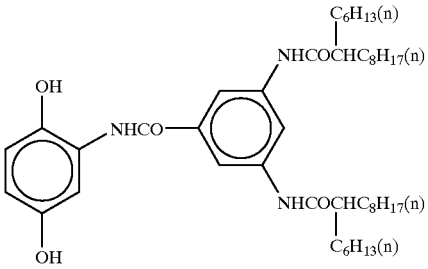
Cpd-2
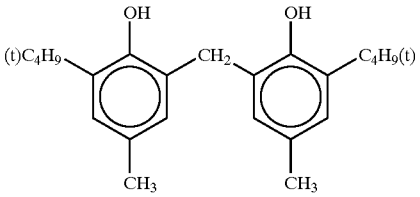

-continued
Cpd-3
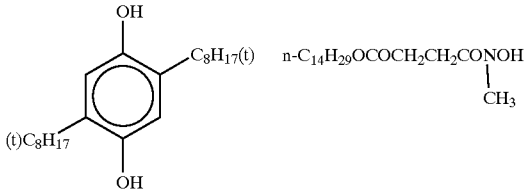
Cpd-4
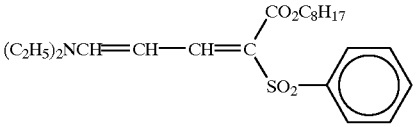
UV-1
UV-2
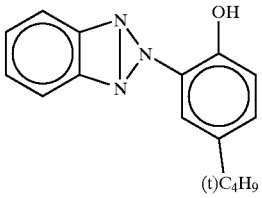
UV-3
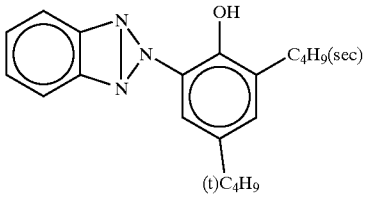
UV-4
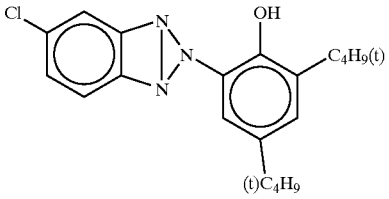
HBS-1
Tricresyl phosphate
HBS-2
Di-n-butyl phthalate
HBS-3
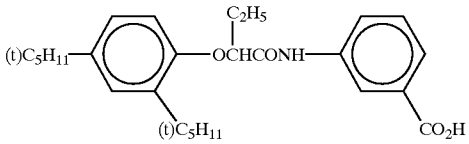
HBS-4
Tri(2-ethylhexyl)phosphate
ExS-1
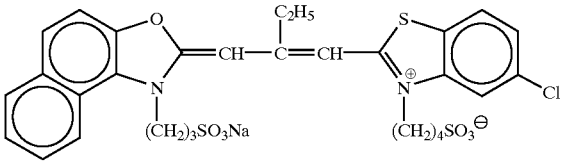
ExS-2
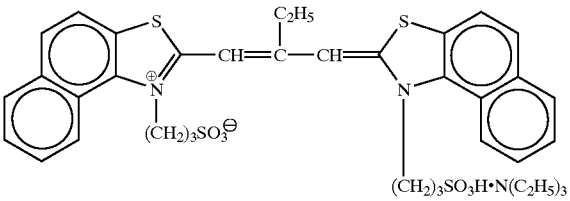
ExS-3
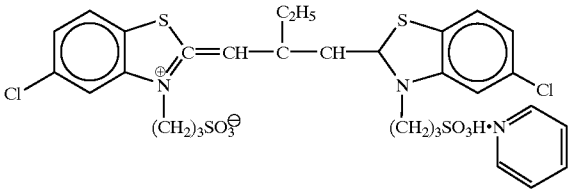
ExS-4
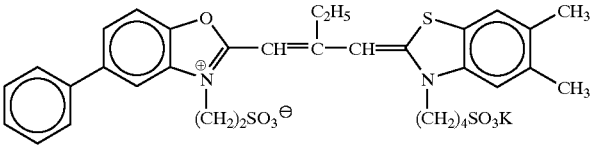
ExS-5
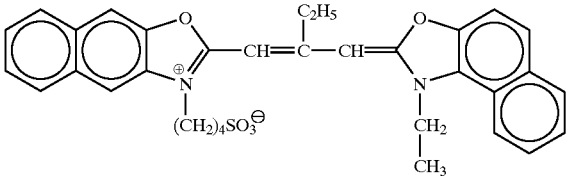

-continued
ExS-6
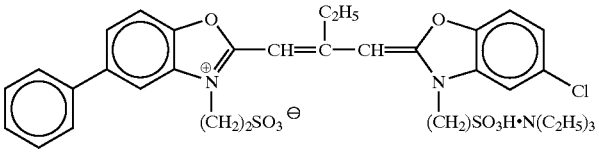
ExS-7
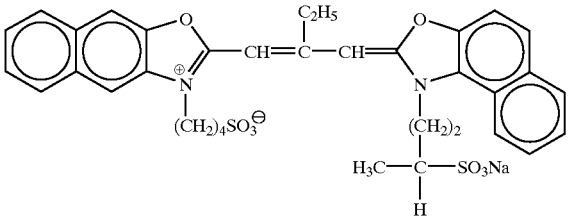
ExS-8
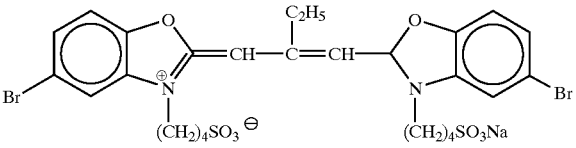
ExS-9
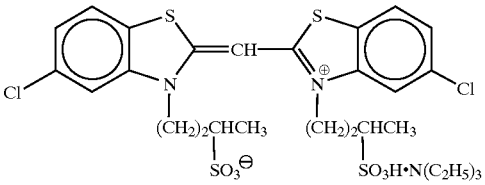
ES-1
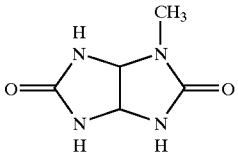
H-1
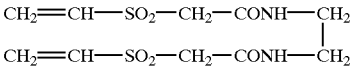
B-1
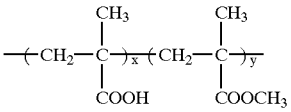
x/y = 10/90 (weight ratio)
Average molecular weight: about 35,000
B-2
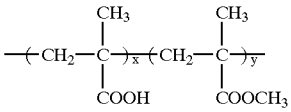
x/y = 45/55 (weight ratio)
Average molecular weight: about 20,000
B-3
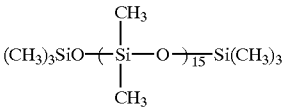
B-4
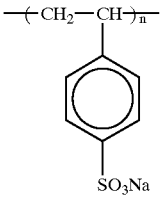
Average molecular weight: about 750,000
B-5
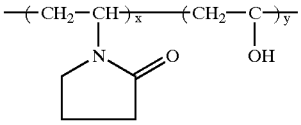
x/y = 70/30 (weight ratio)
Average molecular weight: about 17,000
B-6
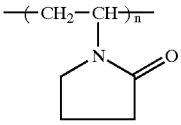
Average molecular weight: about 10,000
W-1
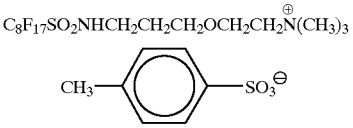
W-2
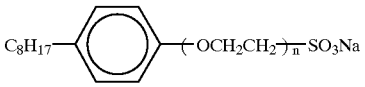
$n$ = 2 - 4
W-3
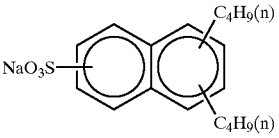
F-1
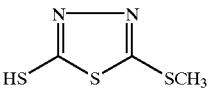

-continued
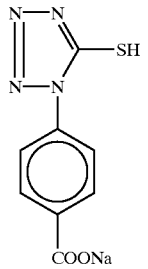
F-2
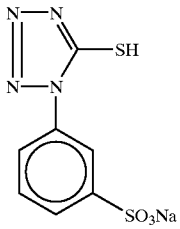
F-3
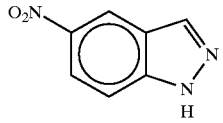
F-4
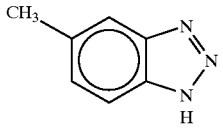
F-5
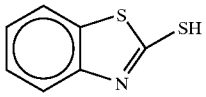
F-6
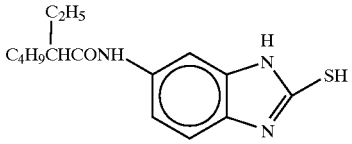
F-7
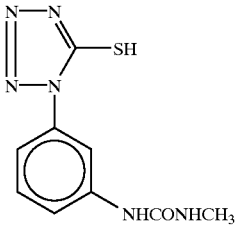
F-8
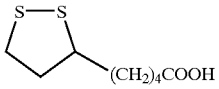
F-9
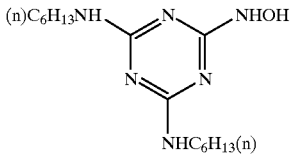
F-10
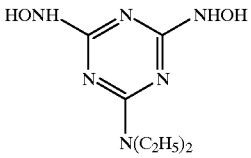
F-11
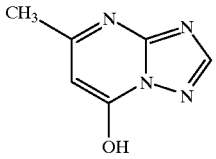
F-12
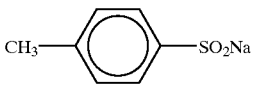
F-13
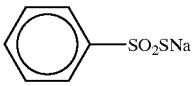
F-14
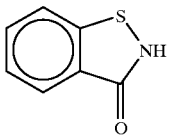
F-15
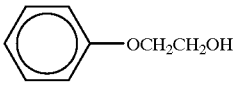
F-16
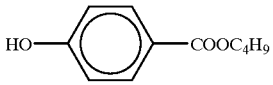
F-17

-continued

F-18

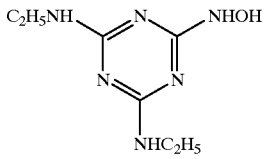

The sensitivity and granularity were evaluated by using the emulsions 1-A to 1-H, 2-A to 2-C, and 3-A to 3-L prepared in Examples 1 to 3 in place of the emulsion D in the sixth layer.

Consequently, it was found that both the sensitivity and granularity were high when the emulsions of the present invention were used as described in Examples 1 to 3.

Example 5

Color reversal sensitive materials were made following the same procedures as for a sample 101 in Example 1 of JP-A-8-122937 except that the emulsions 1-A to 1-H, 2-A to 2-C, and 3-A to 3-L prepared in the present invention were used in the sixth layer (high-speed red-sensitive emulsion layer) of the sample 101.

The photographic properties were evaluated by a method described in Example 1 of JP-A-8-122937, and it was found that high-speed sensitive materials were obtained when the emulsions of the present invention were used. That is, the present invention was found to be effective even in color reversal sensitive materials.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion in which tabular grains each having an equivalent-circle diameter of 0.6 μm or more, a thickness of 0.3 μm or less, and an aspect ratio of 2 or more account for 70% or more in number of all the grains contained in said emulsion, wherein each of said tabular grains has a multilayered structure including two or more layers, at least one of said layers contains 1 to 20 mol % of a chloride with respect to the silver amount contained in said at least one of said layers, and each of said tabular grains contains a metal complex represented by formula (C-1) or (C-2) below:

$$[M_1(CN)_{6-a}L_a]^n \quad \text{(C-1)}$$

$$[M_2(CN)_{4-b}L_b]^m \quad \text{(C-2)}$$

wherein $M_1$ represents Fe, Ru, Re, Os, Ir, or Pt;

$M_2$ represents Pt or Au;

L represents a ligand except for CN;

a represents 0, 1, or 2;

b represents 0, 1, or 2;

n represents 2-, 3-, or 4-;

m represents 1- or 2-; and wherein 80% or more in number of said tabular grains have dislocation lines.

2. The emulsion according to claim 1, wherein the variation coefficient of the equivalent-circle diameter of said tabular grains is 25% or less.

3. The emulsion according to claim 1, wherein the variation coefficient of the equivalent-circle diameter of said tabular grains is 25% or less.

4. The emulsion according to claim 1, wherein the average aspect ratio of said tabular grains is 8 or more.

5. The emulsion according to claim 1, wherein the average aspect ratio of said tabular grains is 8 or more.

6. The emulsion according to claim 2, wherein the average aspect ratio of said tabular grains is 8 or more.

7. The emulsion according to claim 1, wherein the equivalent-circle diameter is 0.6 μm to 5.0 μm.

8. The emulsion according to claim 1, wherein the equivalent-circle diameter is 0.8 μm to 3.0 μm.

9. The emulsion according to claim 1, wherein the thickness is 0.03 μm to 0.30 μm.

10. The emulsion according to claim 1, wherein the thickness is 0.05 μm to 0.20 μm.

11. The emulsion according to claim 1, wherein the chloride contained in said at least one of said layers is 1 mol % to 15 mol %.

12. The emulsion according to claim 1, wherein the chloride contained in said at least one of said layers is 3 mol % to 10 mol %.

13. A silver halide photographic light-sensitive material having one or more silver halide emulsion layers on a support, wherein at least one of the emulsion layers contains said silver halide photographic emulsion according to claim 1.

* * * * *